US010093089B2

(12) United States Patent
Kanda et al.

(10) Patent No.: US 10,093,089 B2
(45) Date of Patent: Oct. 9, 2018

(54) PRINTED MATTER PRODUCING DEVICE

(71) Applicant: Brother Kogyo Kabushiki Kaisha, Nagoya-shi, Aichi-ken (JP)

(72) Inventors: Mitsuhiro Kanda, Nagoya (JP); Satoru Moriyama, Iwakura (JP)

(73) Assignee: BROTHER KOGYO KABUSHIKI KAISHA, Nagoya-Shi, Aichi-Ken (JP)

( * ) Notice: Subject to any disclaimer, the term of this patent is extended or adjusted under 35 U.S.C. 154(b) by 0 days.

(21) Appl. No.: 15/444,655

(22) Filed: Feb. 28, 2017

(65) Prior Publication Data

US 2017/0253027 A1 Sep. 7, 2017

(30) Foreign Application Priority Data

Mar. 1, 2016 (JP) ..... 2016-038760

(51) Int. Cl.
*B41J 2/045* (2006.01)
*B41J 3/407* (2006.01)

(52) U.S. Cl.
CPC ..... *B41J 2/04536* (2013.01); *B41J 2/04586* (2013.01); *B41J 3/4075* (2013.01)

(58) Field of Classification Search
CPC ... B41J 2/04536; B41J 2/04586; B41J 3/4075
(Continued)

(56) References Cited

U.S. PATENT DOCUMENTS

2002/0080395 A1* 6/2002 Kurashina ..... B41J 3/4075 358/1.15
2007/0247665 A1* 10/2007 Rosenfeld ..... G06Q 10/109 358/1.18
(Continued)

FOREIGN PATENT DOCUMENTS

JP 2006-272760 A 10/2006
JP 2008-015846 A 1/2008
(Continued)

OTHER PUBLICATIONS

Japanese Office Action dated Jun. 12, 2018 in Japanese Patent Application No. 2016-038760.

*Primary Examiner* — Huan Tran
*Assistant Examiner* — Alexander D Shenderov
(74) *Attorney, Agent, or Firm* — Scully, Scott, Murphy & Presser, P.C.

(57) ABSTRACT

The disclosure discloses a printed matter producing device including a unique information acquiring portion, an identifier determining portion, a bar-coding portion, and a control portion. The unique information acquiring portion is configured to acquire unique information uniquely retained by the printed matter producing device. The identifier determining portion is configured to read a template so as to determine whether a predetermined collection identifier exists or not in the read template. The bar-coding portion is configured to generate and expand print data to a printing buffer in the case that the collection identifier is present, the print data having the unique information acquired and assigned to contents of the bar-code object included in the template. The control portion is configured to, by using the print data expanded to the printing buffer, to produce the printed matter having a bar-code print portion corresponding to the bar-code object.

7 Claims, 22 Drawing Sheets

(58) Field of Classification Search
USPC ..... 347/14
See application file for complete search history.

(56) References Cited

U.S. PATENT DOCUMENTS

| | | | |
|---|---|---|---|
| 2008/0007781 | A1 | 1/2008 | Oike et al. |
| 2009/0106649 | A1 | 4/2009 | Nose |
| 2014/0092409 | A1 | 4/2014 | Ito |
| 2014/0347412 | A1 | 11/2014 | Jintsugawa et al. |
| 2016/0042574 | A1 | 2/2016 | Yoshie |
| 2016/0257134 | A1 | 9/2016 | Jintsugawa et al. |

FOREIGN PATENT DOCUMENTS

| | | | |
|---|---|---|---|
| JP | 2009-093245 | A | 4/2009 |
| JP | 2014-071583 | A | 4/2014 |
| JP | 2014-226869 | A | 12/2014 |
| WO | 2014/91709 | A1 | 6/2014 |

* cited by examiner

[FIG. 1]
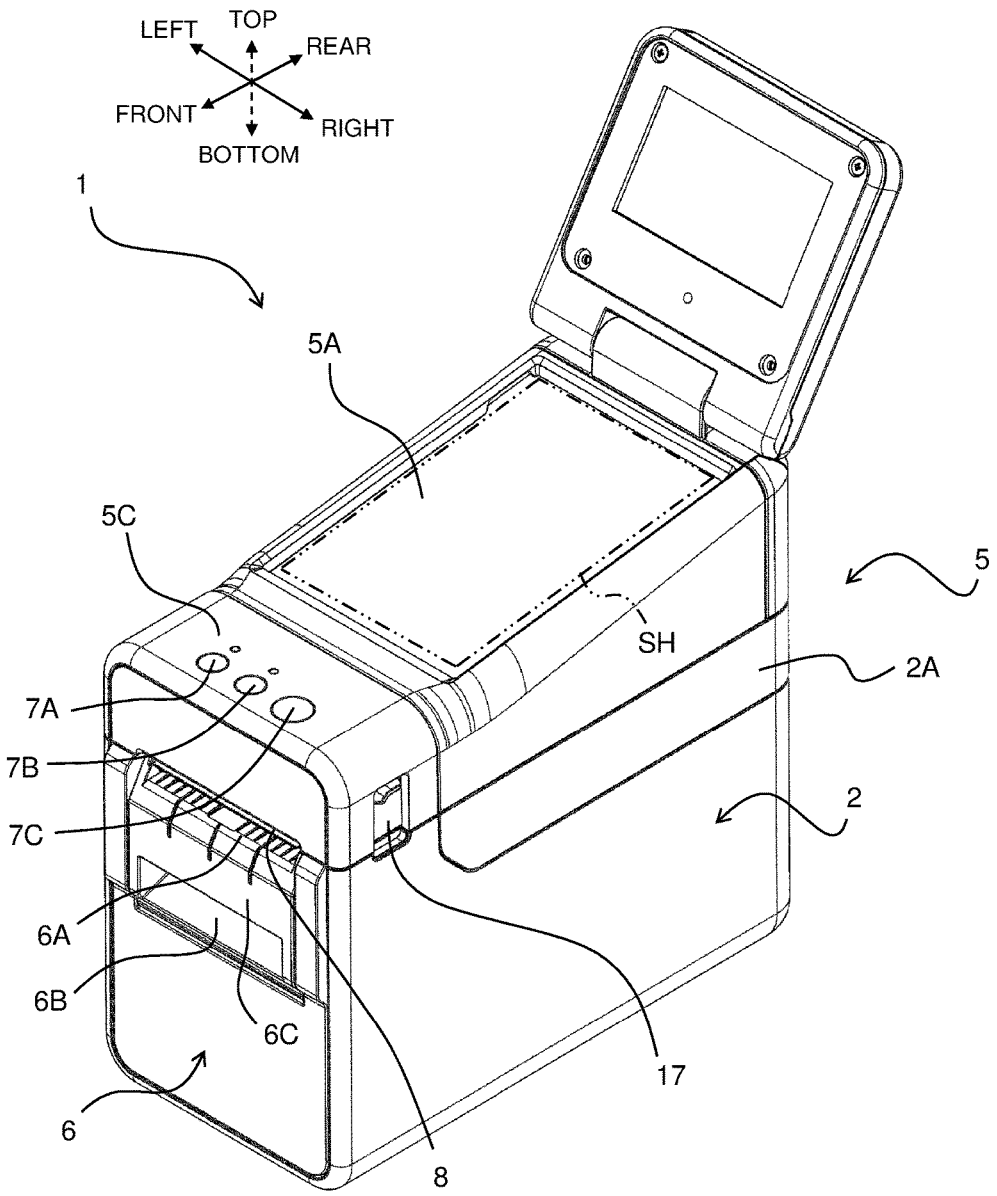

[FIG. 2]
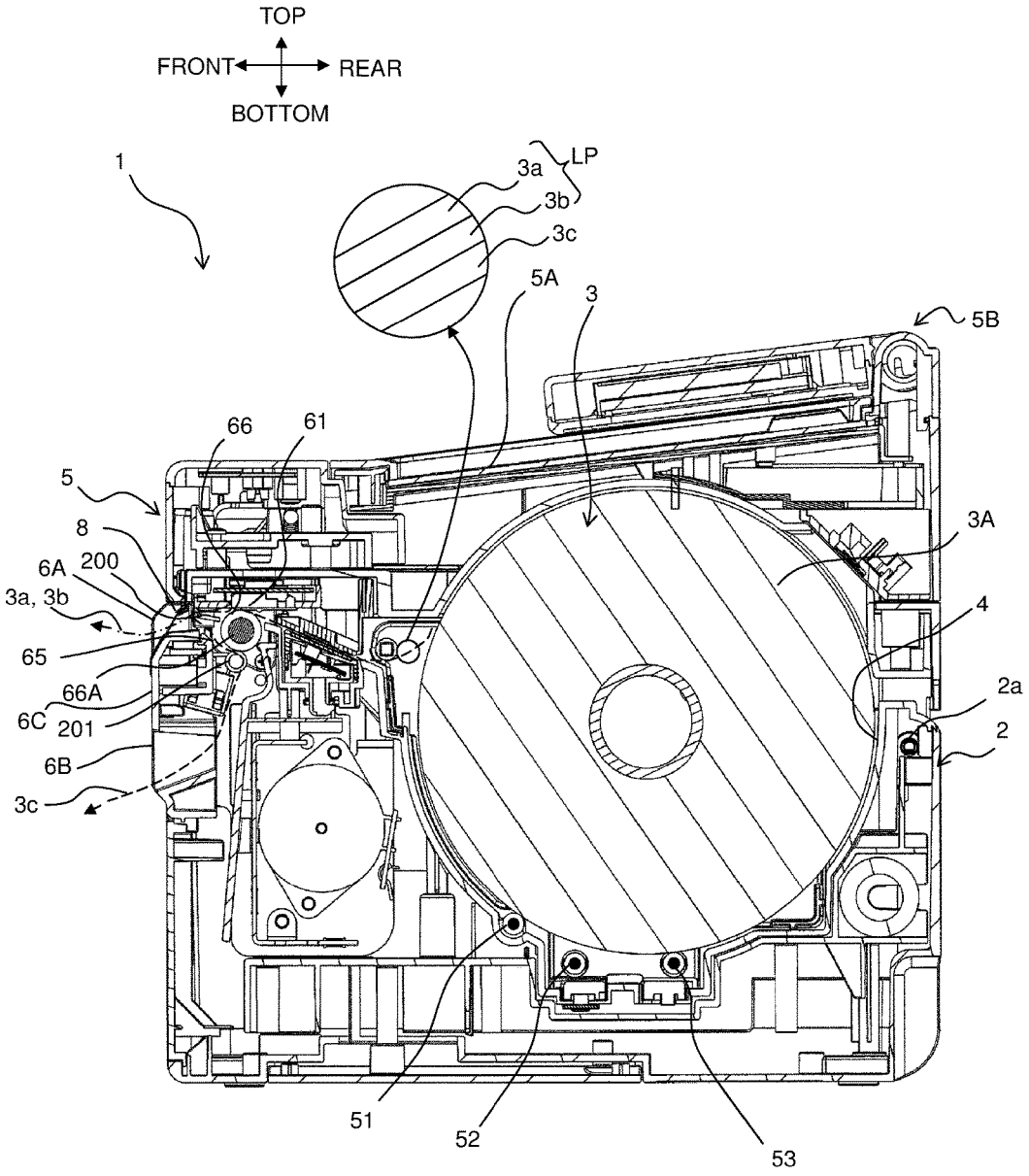

[FIG. 3]
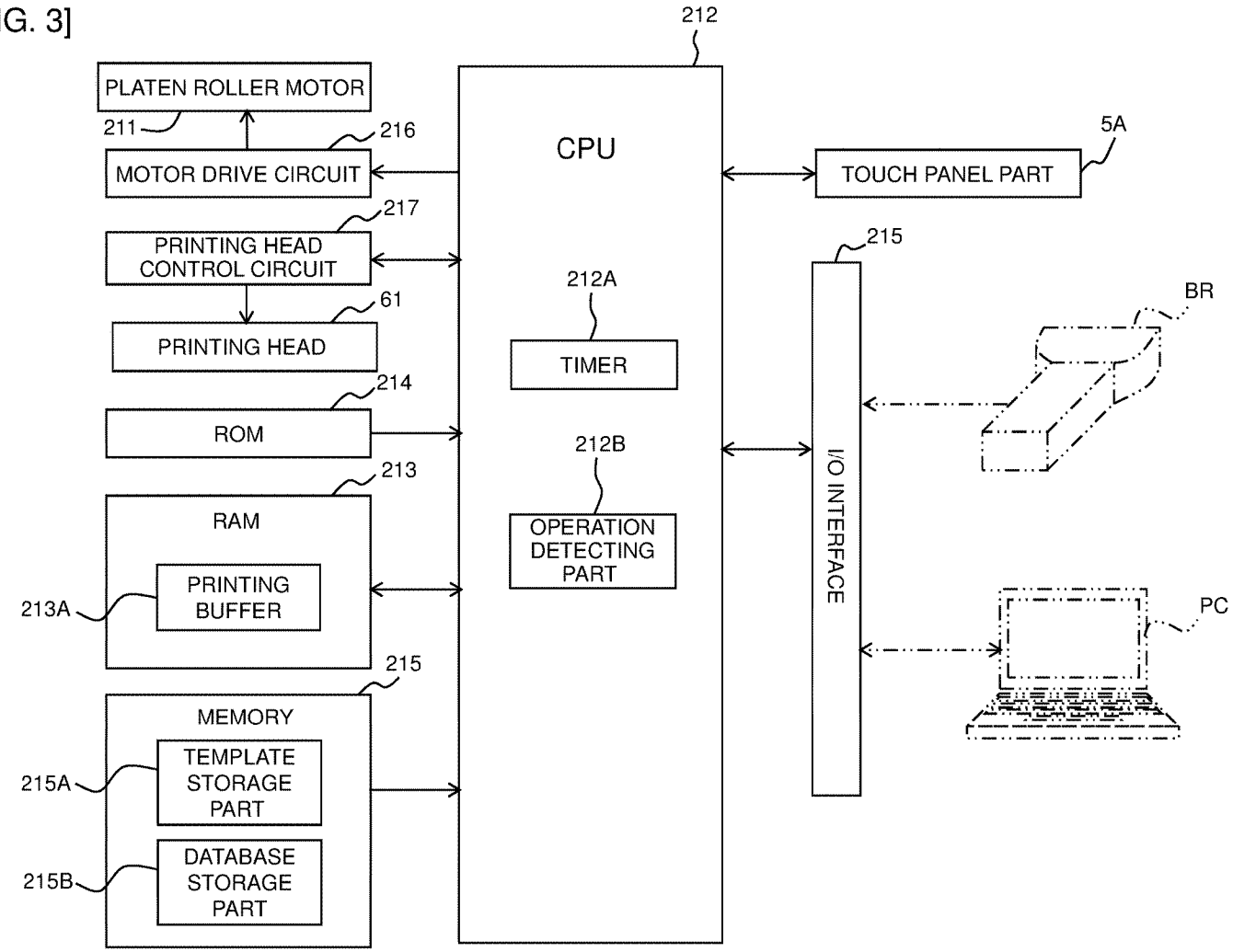

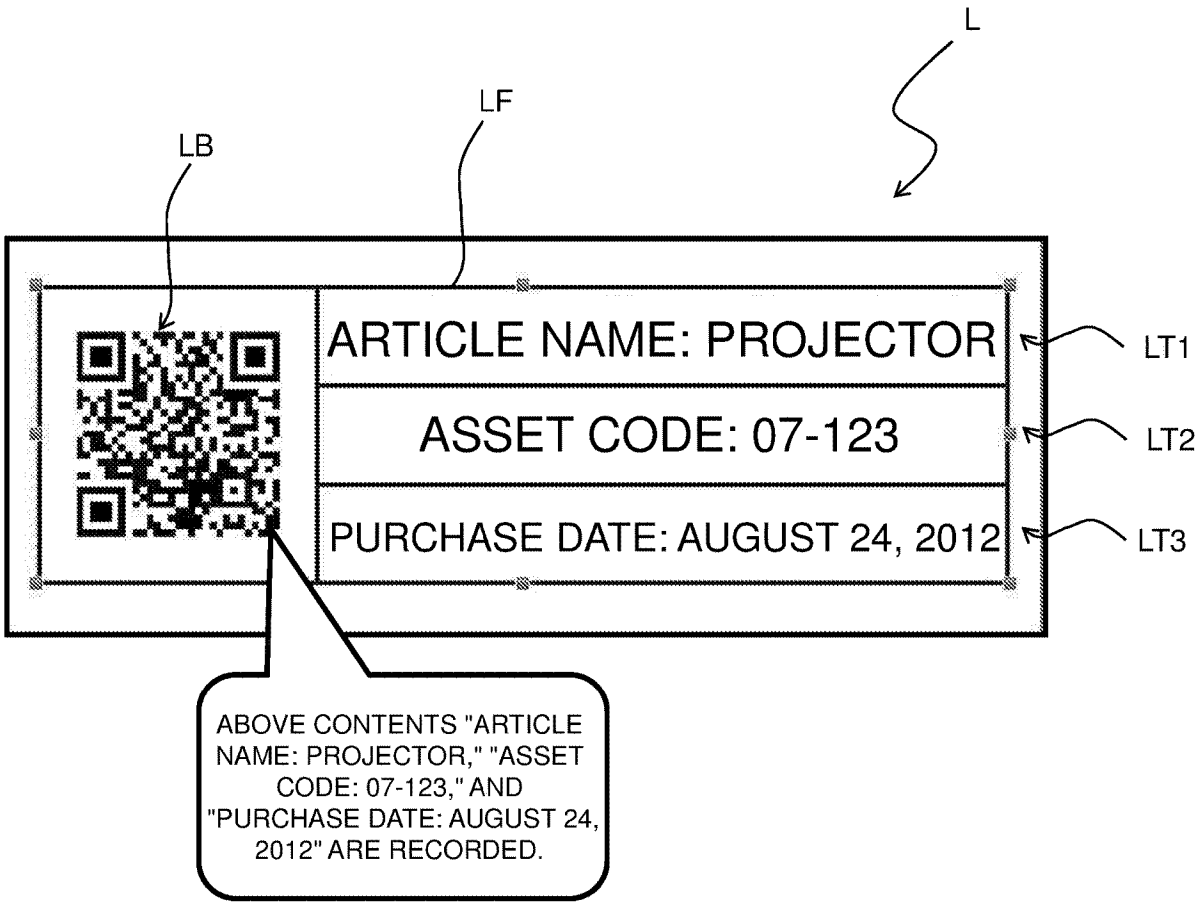
[FIG. 4]

[FIG. 5]

30

| 31 RECORD NUMBER | 32 ARTICLE NAME | 33 ASSET CODE | 34 PURCHASE DATE |
|---|---|---|---|
| 1 | PROJECTOR | 07-123 | 2012/8/24 |
| 2 | PRINTER | 09-224 | 2014/2/5 |
| 3 | PRINTER | 09-196 | 2014/7/19 |
| 4 | COPY MACHINE | 08-071 | 2010/1/26 |
| 5 | WHITEBOARD | 00-348 | 2015/3/3 |
| ... | ... | ... | ... |

[FIG. 6A]
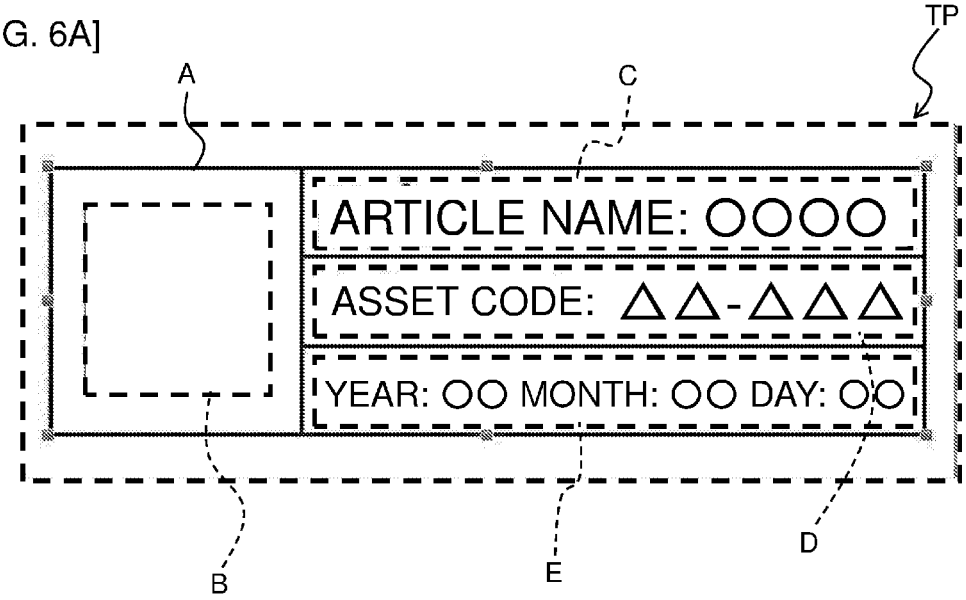
INSERT DATA FROM DATABASE
[FIG. 6B]
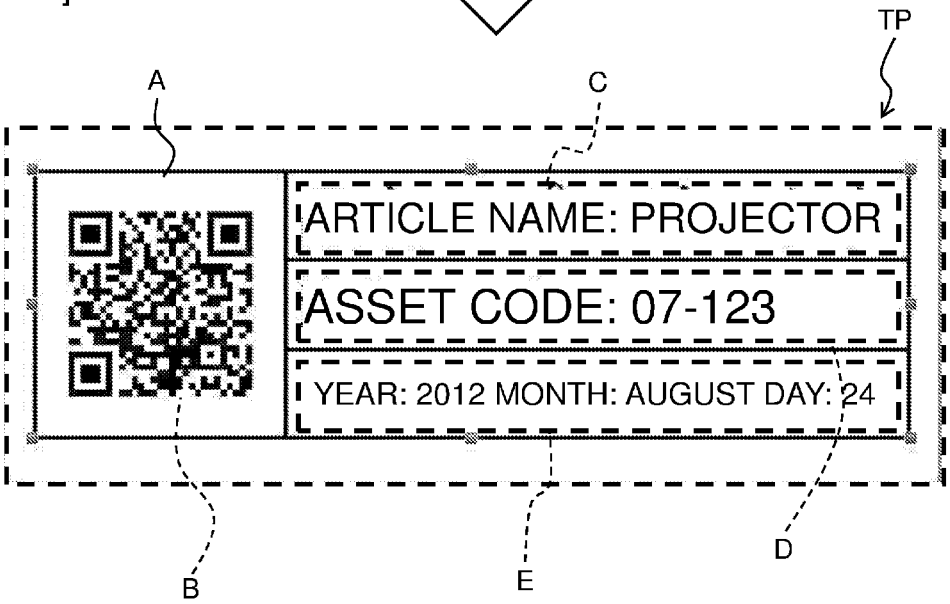

[FIG. 7]
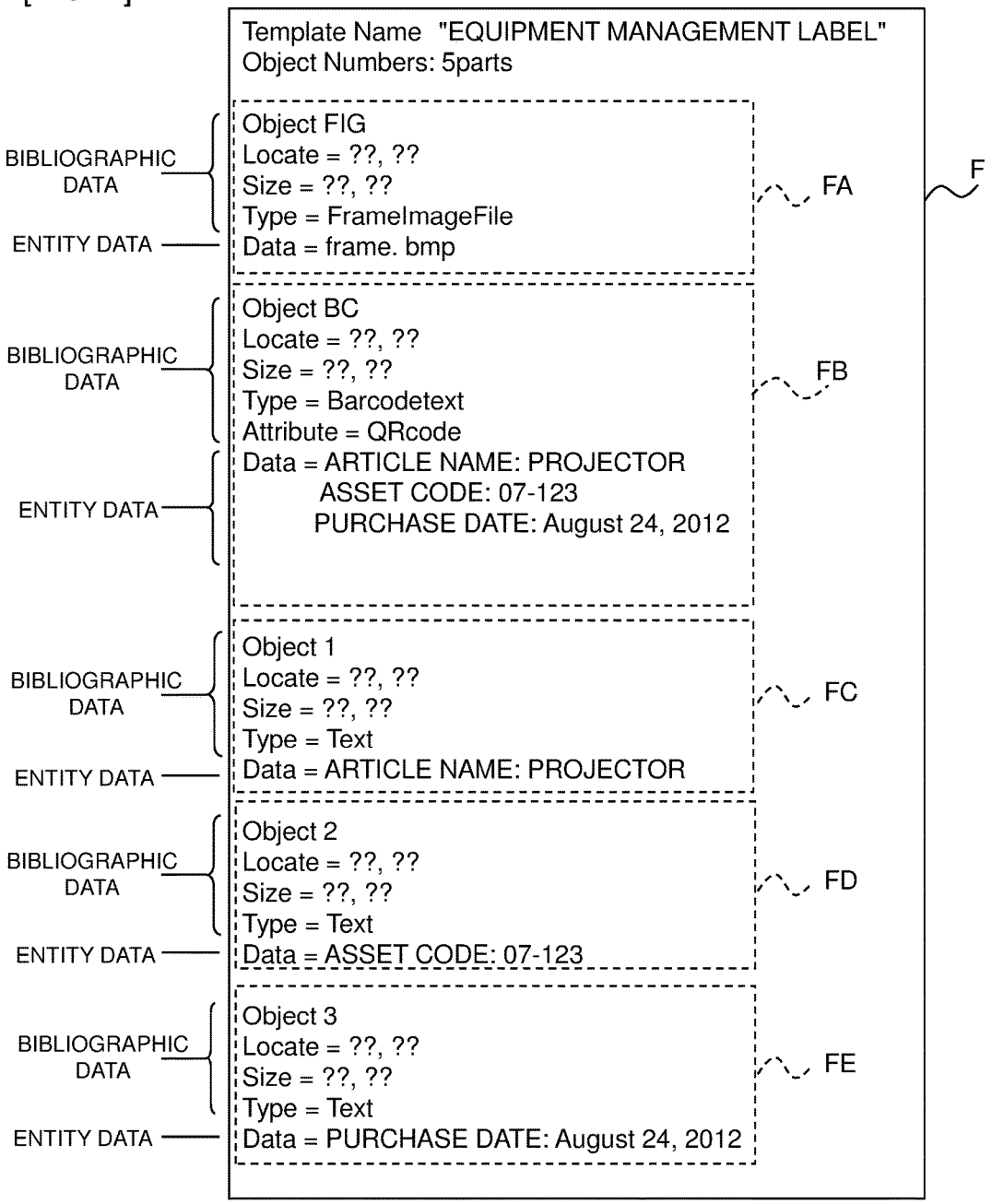

[FIG. 8]
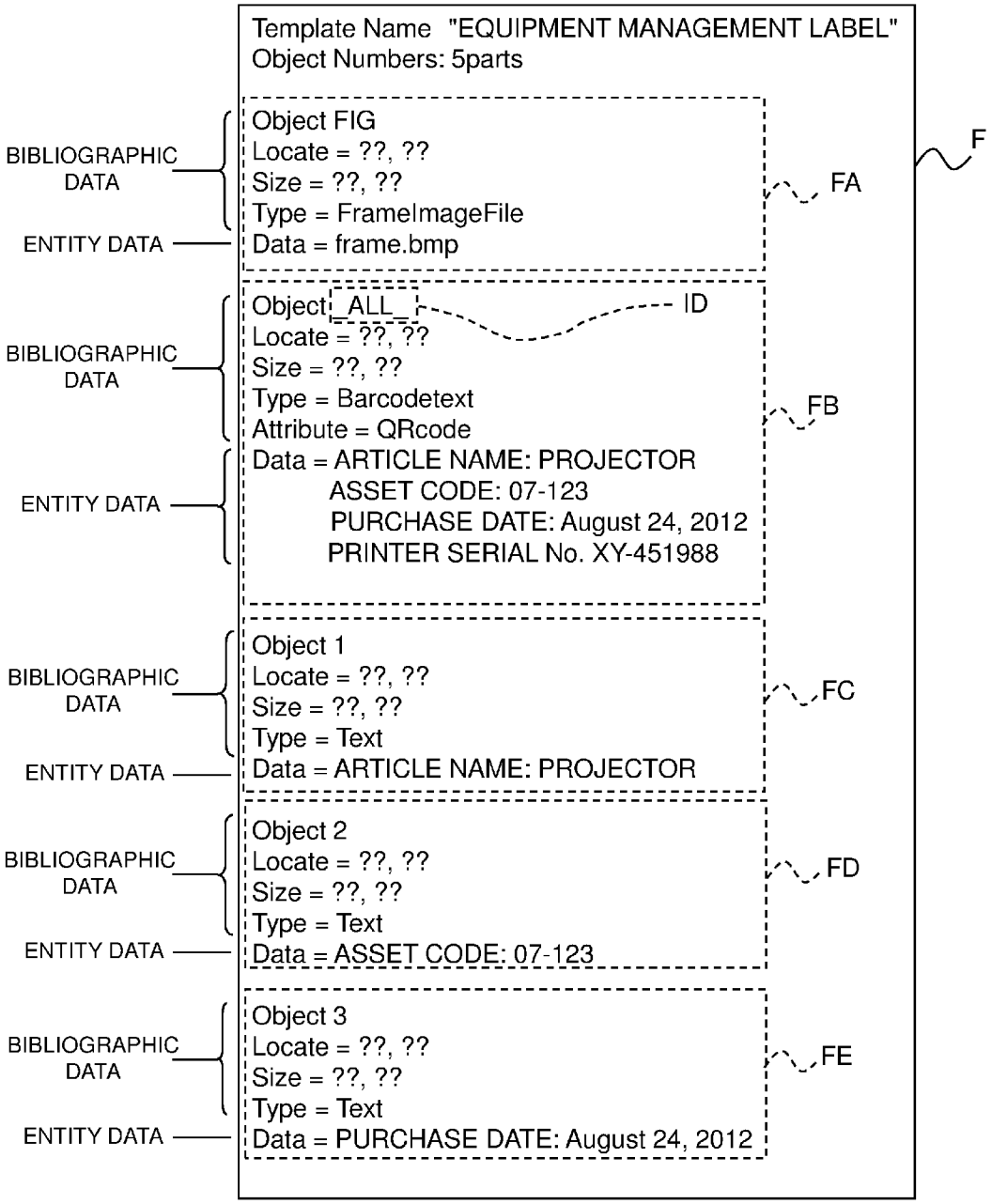

[FIG. 9]
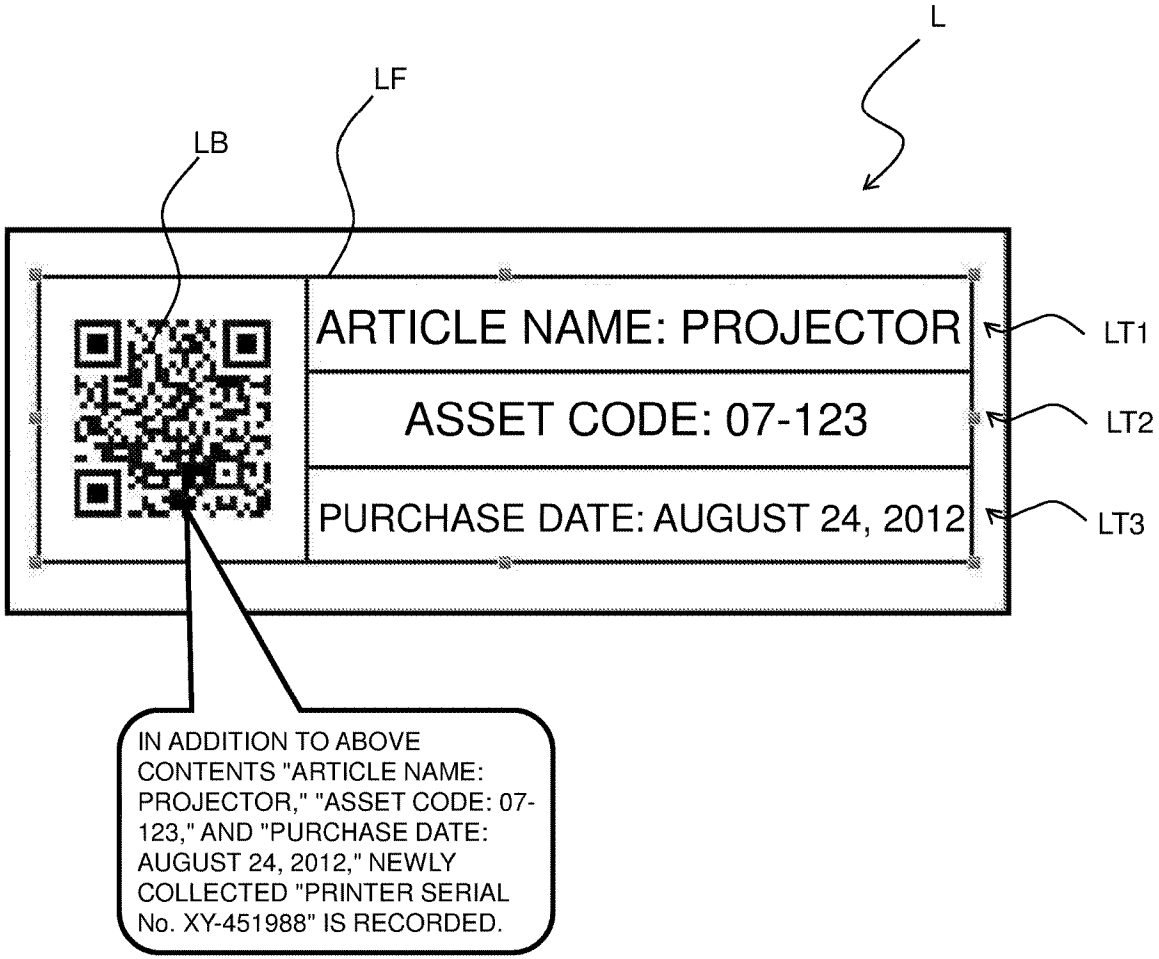

[FIG. 10]
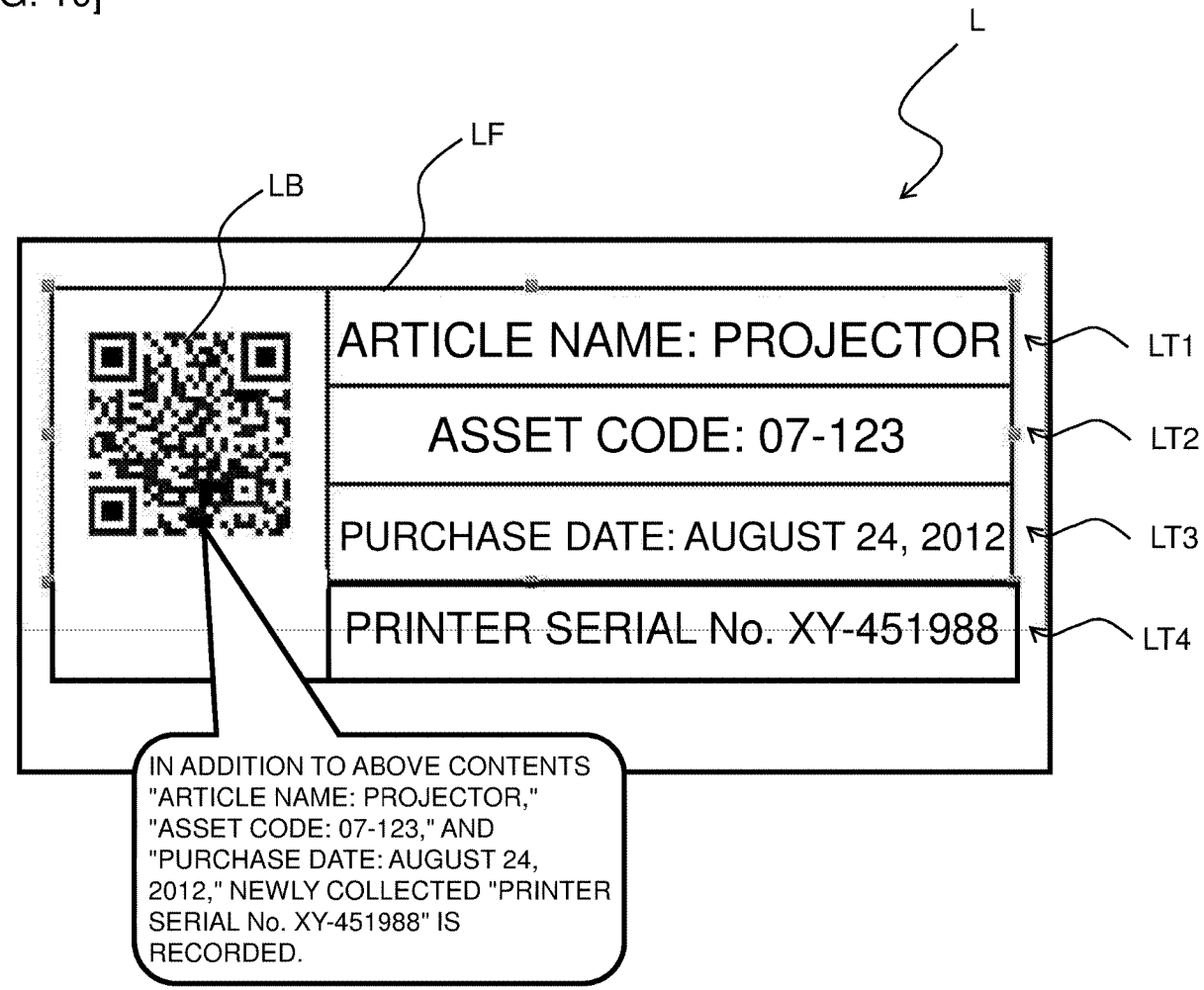

[FIG. 11]
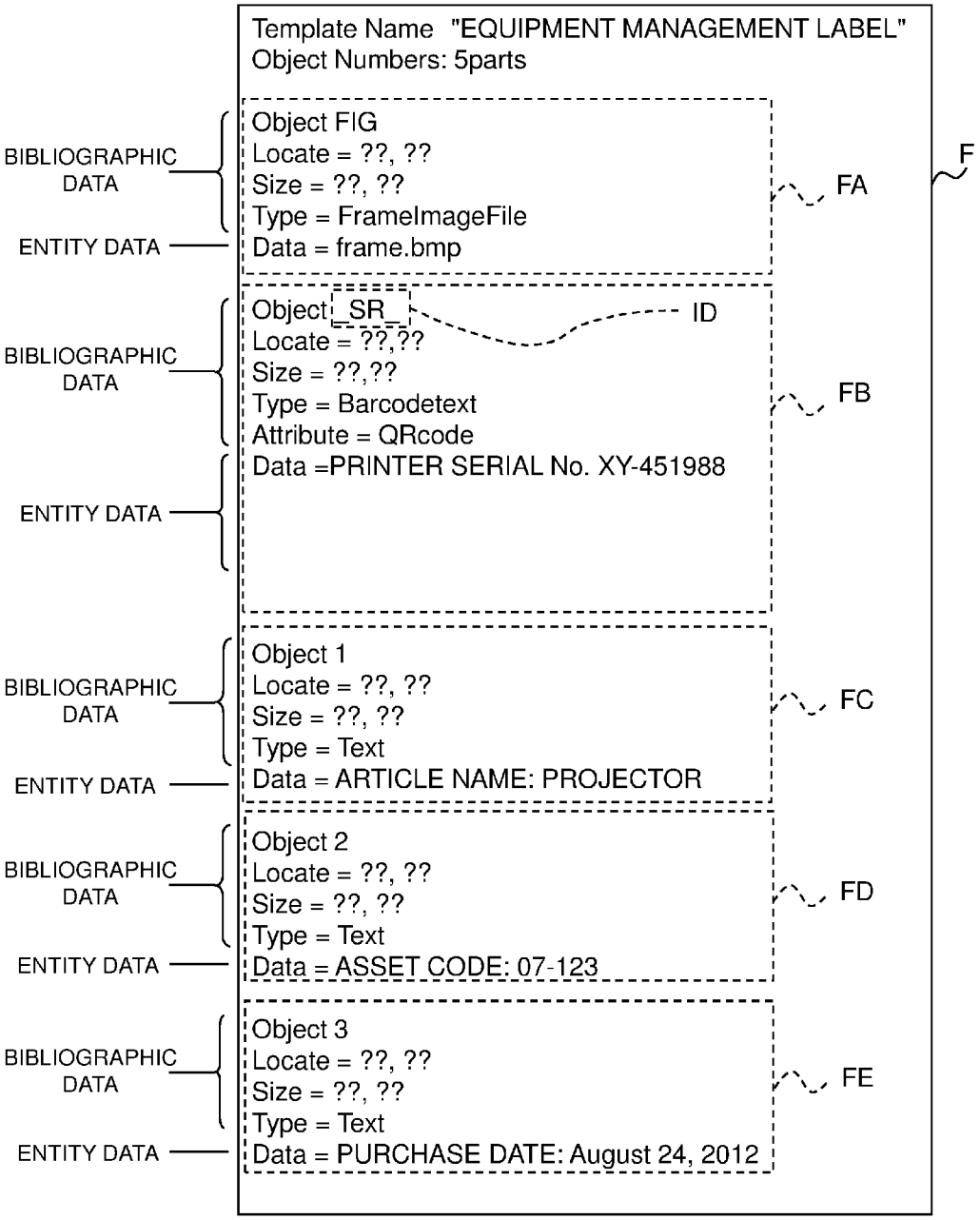

[FIG. 12]
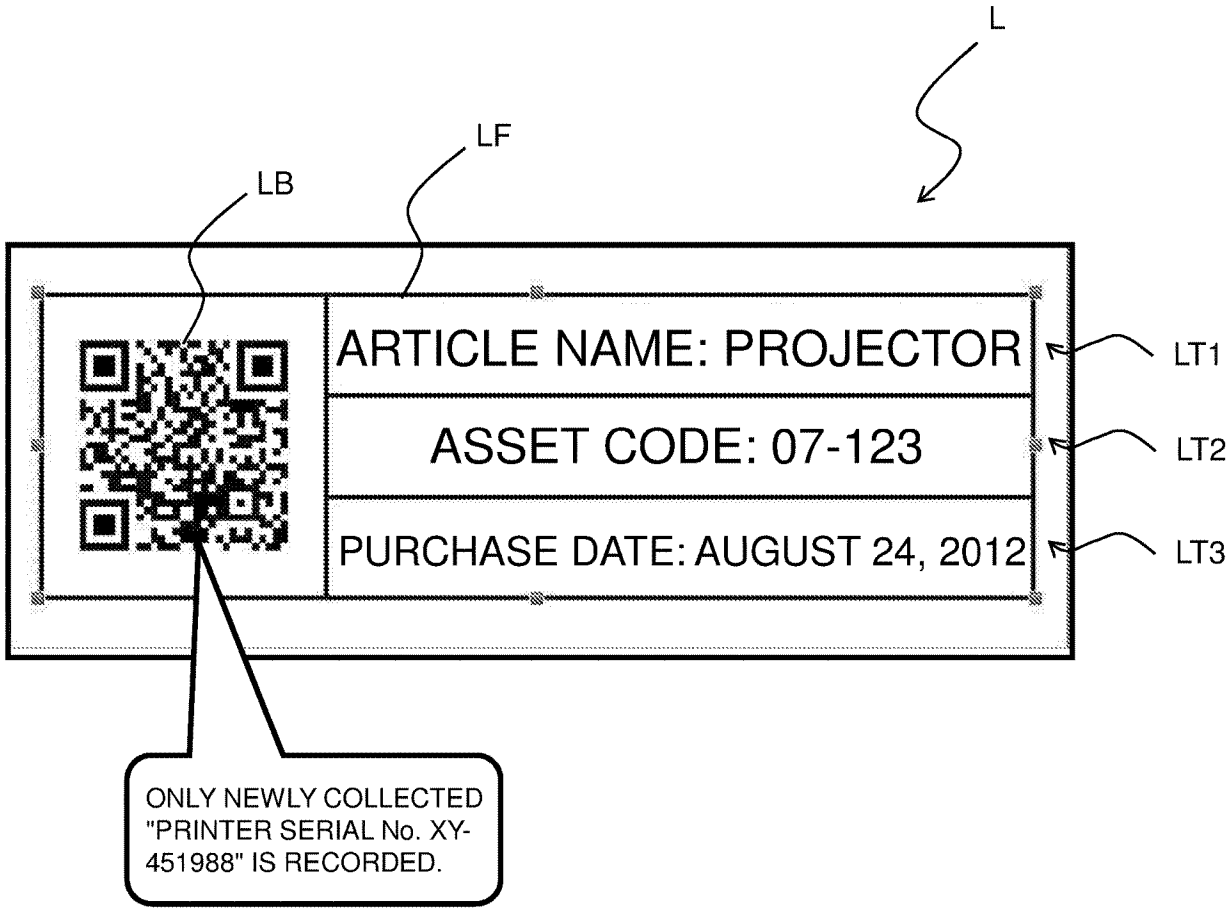

[FIG. 13]
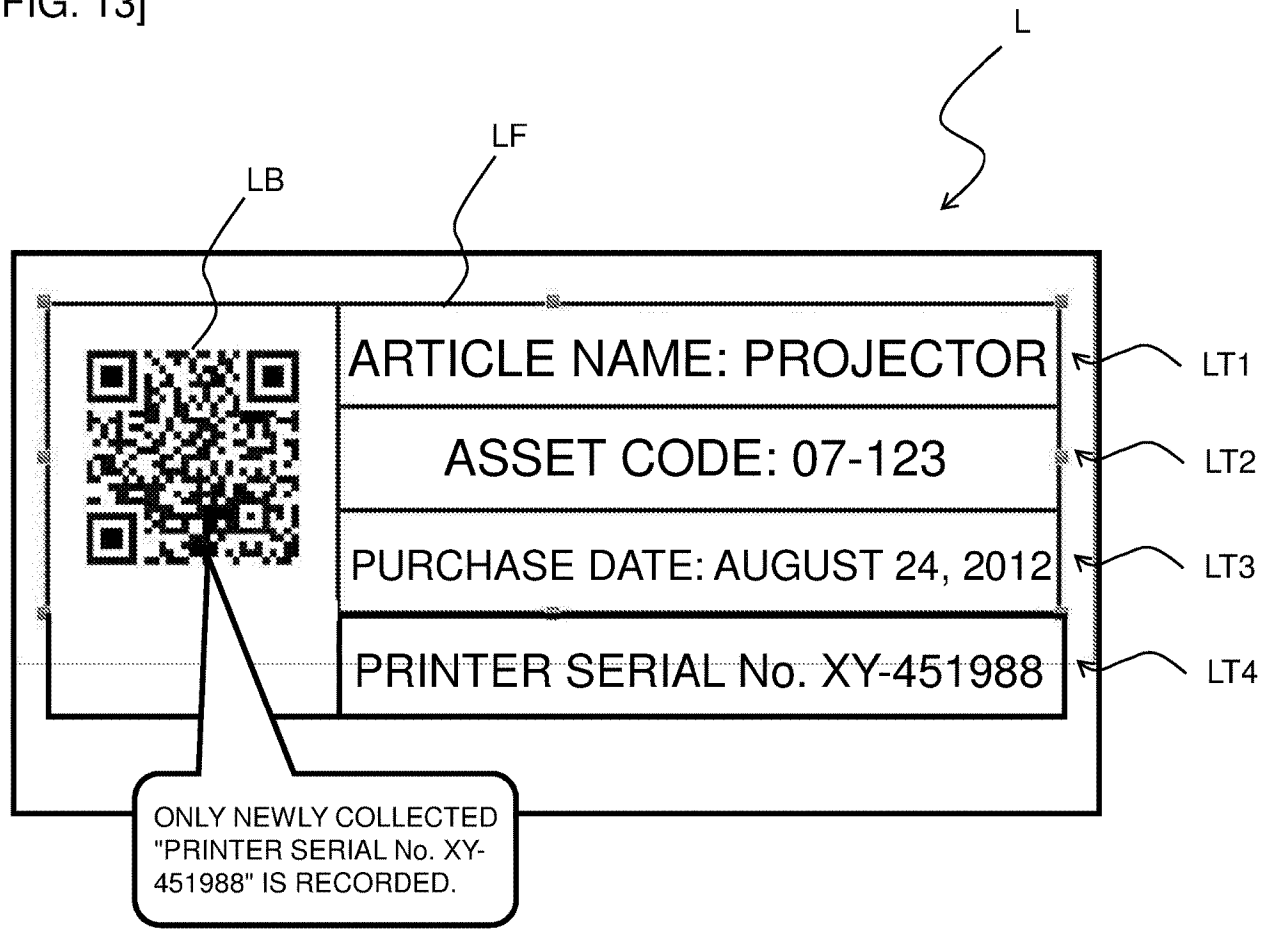

[FIG. 14]
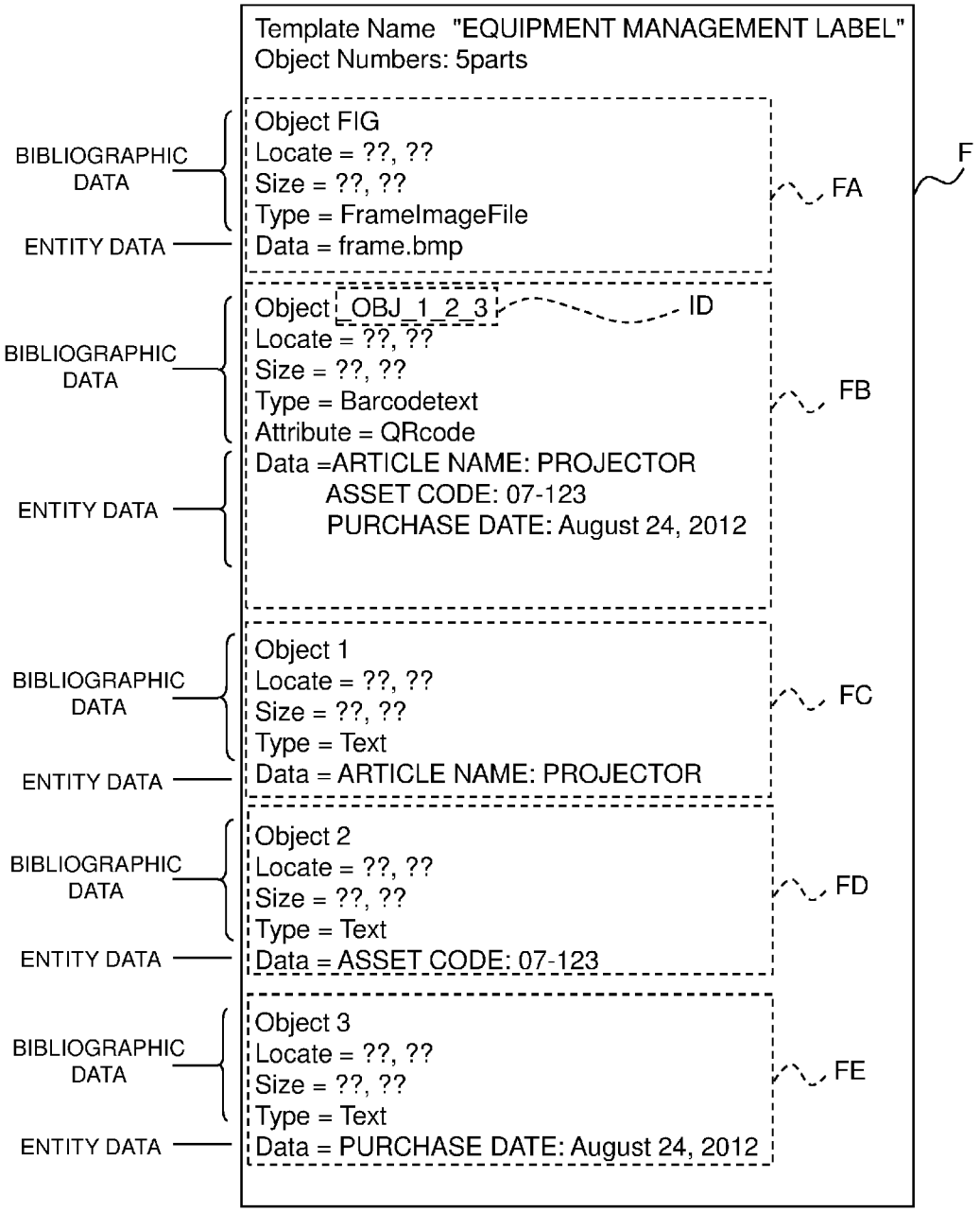

[FIG. 15]
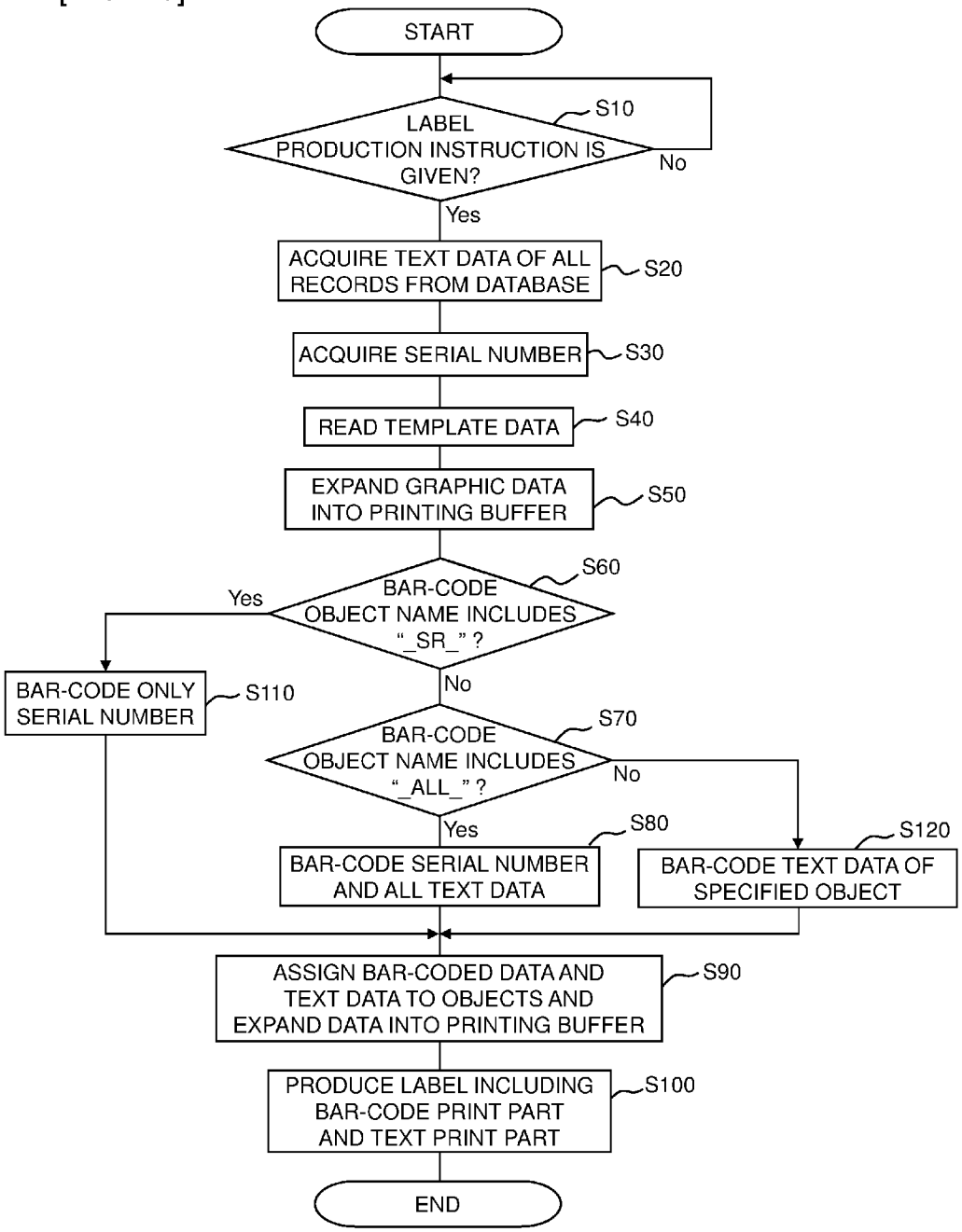

[FIG. 16]
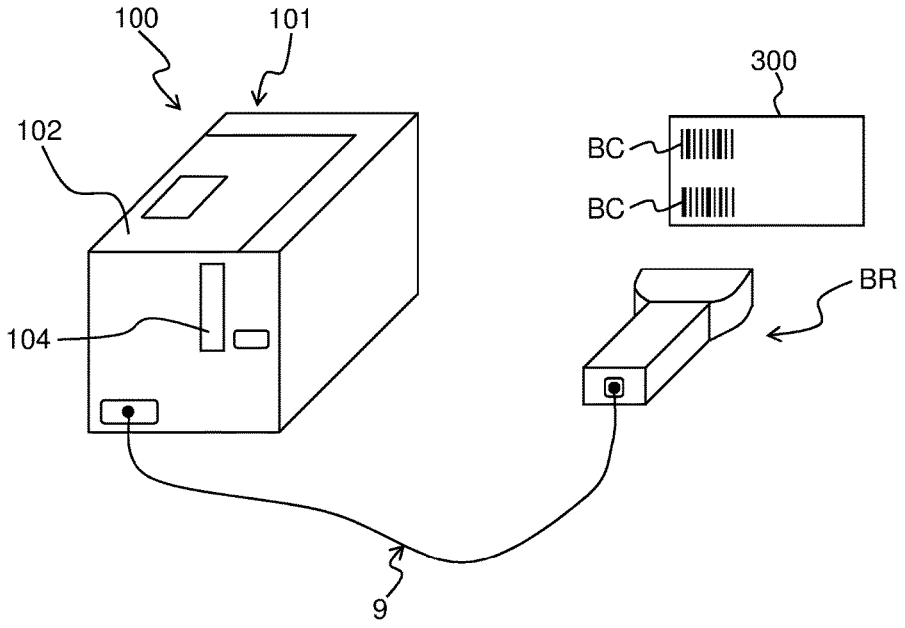

[FIG. 17]
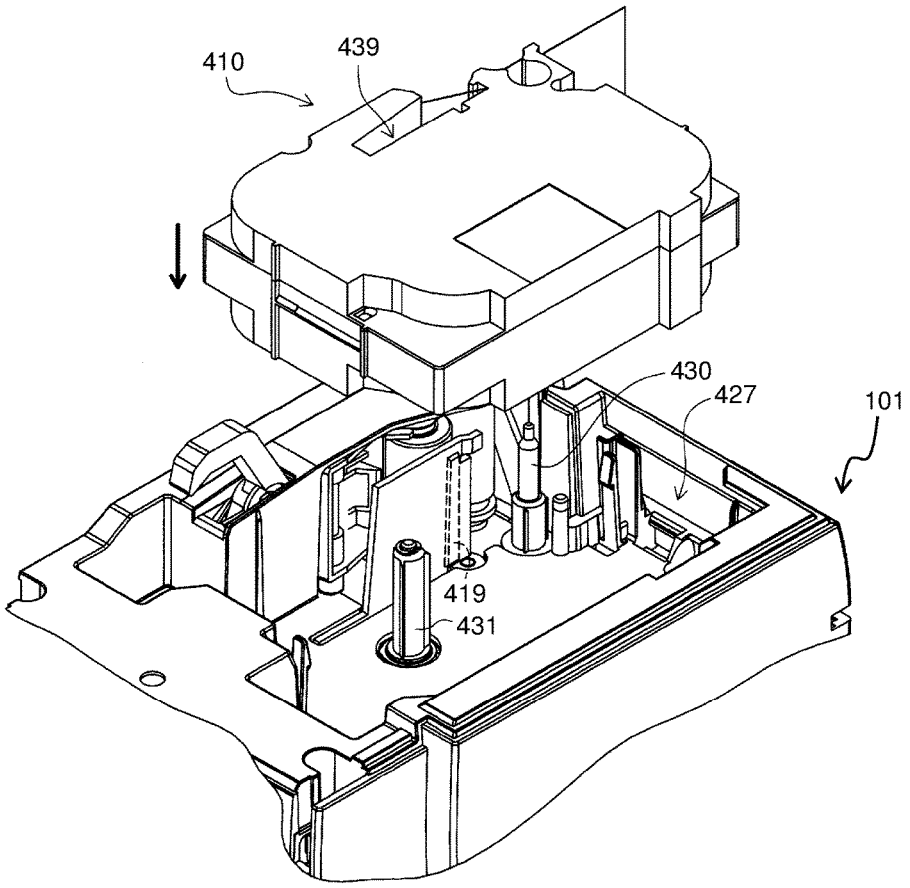

[FIG. 18]
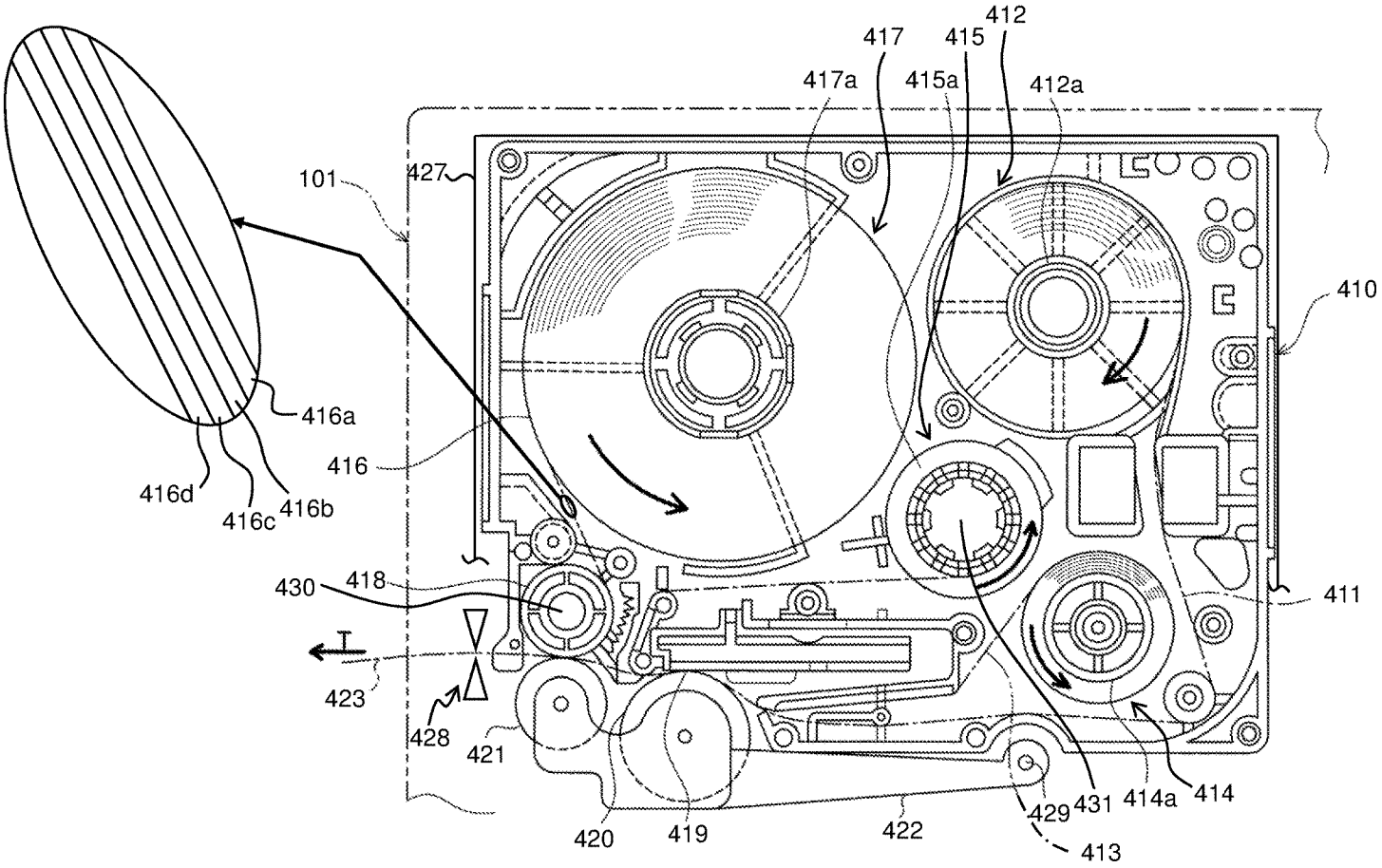

[FIG. 19]
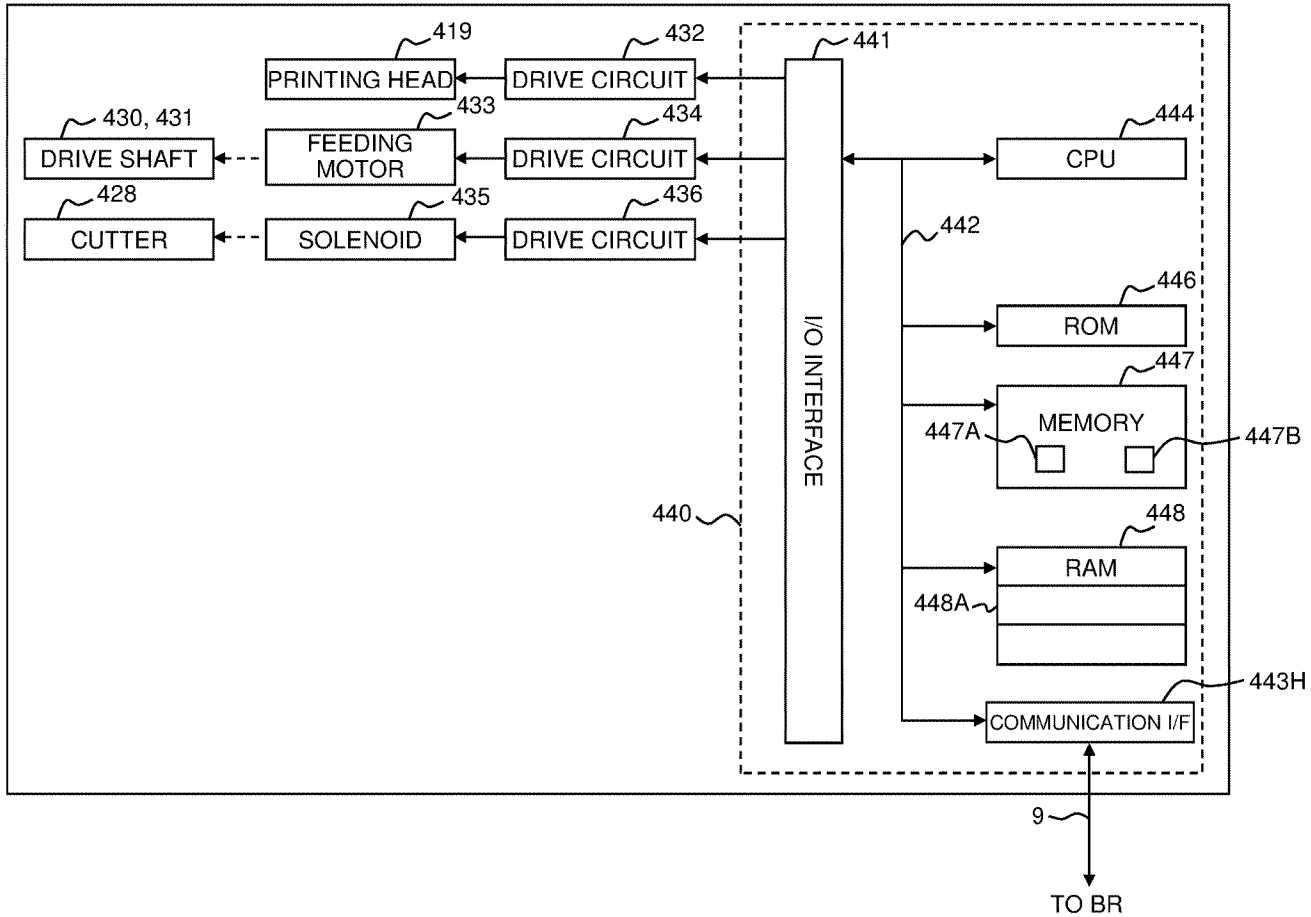

[FIG. 20]
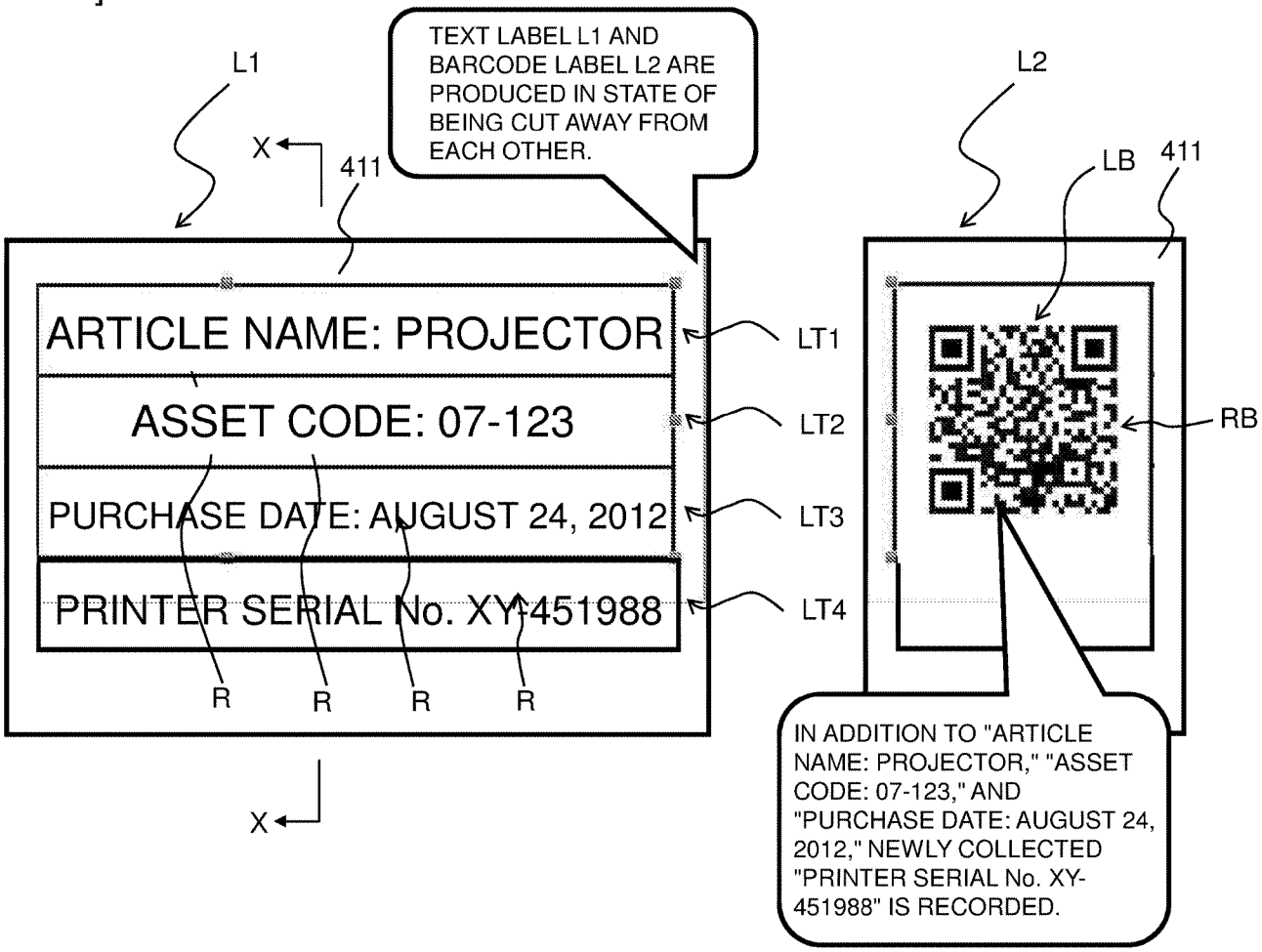

[FIG. 21]
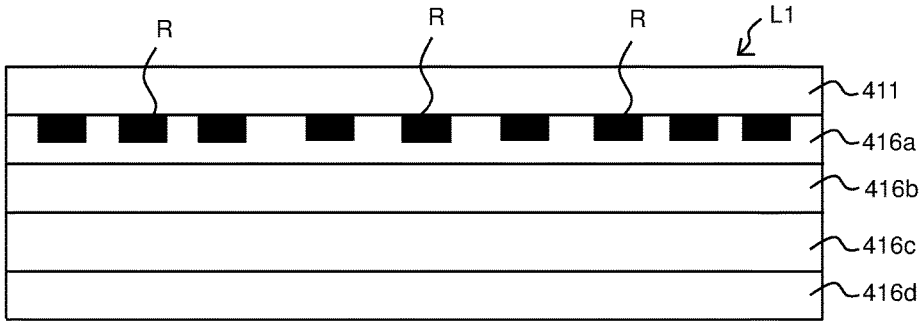

[FIG. 22]
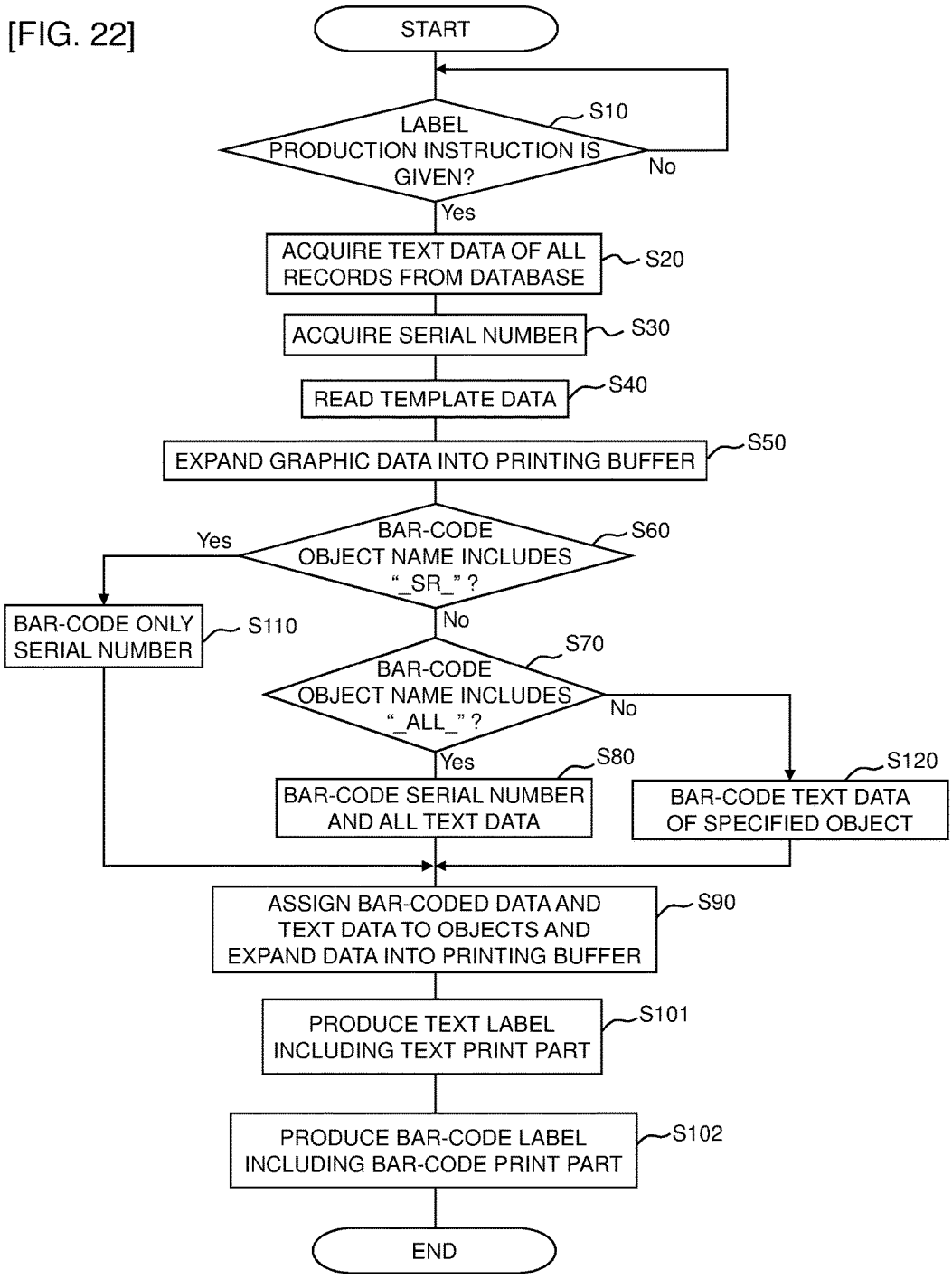

PRINTED MATTER PRODUCING DEVICE

CROSS-REFERENCE TO RELATED APPLICATION

The present application claims priority from Japanese Patent Application No. 2016-038760, which was filed on Mar. 1, 2016, the disclosure of which is incorporated herein by reference in its entirety.

BACKGROUND

Field

The present disclosure relates to a printed matter producing device performing a desired print on a print-receiving medium to produce a printed matter.

Description of the Related Art

A printer is known that is capable of printing on a print-receiving medium (tape) to produce a printed matter (label). This prior art printed matter producing device imports a database from a high-function terminal such as a PC and a smartphone, for example, and prints a plurality of items (hereinafter referred to as "object data") included in respective multiple records of the imported database on a print-receiving medium to produce a printed matter (so-called database printing). In this printing, the object data of the records can automatically be bar-coded and formed as a print in the printed matter.

Recently, a new need has arisen for generating a bar code representative of unique information uniquely retained by a printed matter producing device (in other words, hardly acquired by equipment etc. connected to the printed matter producing device) and forming the bar code as a print in a printed matter at the time of the database printing. In such a case, in the prior art, a connected high function terminal must extract the unique information from the printed matter producing device before producing data and newly giving an instruction to the printed matter producing device, and this is inconvenient.

SUMMARY

It is therefore an object of the present disclosure to provide a printed matter producing device capable of easily producing a printed matter displaying bar-coded unique information of the device.

In order to achieve the above-described object, according to an aspect of the present application, there is provided a printed matter producing device comprising a feeder, a printing head, a template memory, an instruction accepting portion, a unique information acquiring portion, an identifier determining portion, a bar-coding portion, and a control portion. The feeder is configured to feed a print-receiving medium. The printing head is configured to perform a print on the printing-receiving medium. The template memory is configured to store a template configured to have at least one print object that includes a bar-code object and is allocated in a predetermined form. The instruction accepting portion is configured to accept a production instruction for a printed matter by means of using the print-receiving medium. The unique information acquiring portion is configured to use the acceptance of the production instruction by the instruction accepting portion as a trigger to acquire unique information uniquely retained by the printed matter producing device. The identifier determining portion is configured to use the acceptance of the production instruction by the instruction accepting portion as a trigger to read the template stored in the template memory so as to determine whether a predetermined collection identifier exists or not in the read template. The bar-coding portion is configured to generate and expand print data to a printing buffer in the case that the identifier determining portion determines that the collection identifier is present, the print data having the unique information acquired by the unique information acquiring portion bar-coded and assigned to contents of the bar-code object included in the template. The control portion is configured to control the feeder and the printing head by using the print data expanded to the printing buffer by the bar-coding portion so as to produce the printed matter having a bar-code print portion corresponding to the bar-code object after the assignment is applied.

BRIEF DESCRIPTION OF THE DRAWINGS

FIG. 1 is a perspective view of an appearance of a print label producing device according to a first embodiment of the present disclosure.

FIG. 2 is a side cross-sectional view of a general structure of the print label producing device.

FIG. 3 is a functional block diagram of a control system of the print label producing device.

FIG. 4 is a diagram of an example of a produced print label.

FIG. 5 is an explanatory view of an example of a database.

FIG. 6A is an explanatory view of a state before data of the database is inserted into a template.

FIG. 6B is an explanatory view of a state after the data of the database is inserted into the template.

FIG. 7 is a schematic for conceptually explaining a data structure of the template.

FIG. 8 is a schematic for conceptually explaining a data structure when a collection identifier is included in identification information of a bar-code object.

FIG. 9 is an appearance view of an example of a print label produced with the template of FIG. 8.

FIG. 10 is an appearance view of a print label representative of a modification example in which a serial number is displayed also on a text print portion.

FIG. 11 is a schematic for conceptually explaining a data structure when a collection identifier is included in the identification information of the bar-code object.

FIG. 12 is an appearance view showing an example of a print label produced with the template of FIG. 11.

FIG. 13 is an appearance view of a print label representative of a modification example in which a serial number is displayed also on the text print portion.

FIG. 14 is a schematic for conceptually explaining a data structure when a collection identifier is not included in the identification information of the bar-code object.

FIG. 15 is a flowchart of control carried out by a CPU.

FIG. 16 is a configuration diagram of a label printer of a second embodiment of the present disclosure shown together with a connected bar-code reader.

FIG. 17 is a perspective view of an appearance configuration of a cartridge holder inside a device body and a cartridge to be attached thereto with an opening/closing lid of the label producing device opened.

FIG. 18 is a view of a peripheral portion of the cartridge holder with a cartridge attached thereto shown together with the cartridge.

FIG. 19 is a functional block diagram of a functional configuration of the label producing device.

FIG. 20 is an appearance view of an example of a produced print label.

FIG. 21 is a cross-sectional view taken along a line X-X of FIG. 20.

FIG. 22 is a flowchart of control carried out by a CPU.

DETAILED DESCRIPTION OF THE PREFERRED EMBODIMENTS

Embodiments of the present disclosure will now be described with reference to the drawings.

A first embodiment of the present disclosure will be described with reference to FIGS. 1 to 15.

<General Appearance Configuration>

An appearance configuration of a print label producing device according to this embodiment will be described with reference to FIG. 1. In the following description, the front-back direction, the left-right direction, and the up-down direction indicate the directions of arrows shown as appropriate in FIG. 1.

In FIG. 1, a print label producing device 1 (corresponding to a printed matter producing device) of this embodiment has a device housing 2 constituting an outer contour of the device and including a front panel 6, and an upper cover unit 5. The device housing 2 and the upper cover unit 5 are made of resin, for example. The upper cover unit 5 has a touch panel part 5A and an operation button part 5C.

The upper cover unit 5 is pivotally connected to the device housing 2 through a rotating shaft part 2*a* (see FIG. 2 described later) at the rear end portion, so that the upper cover unit 5 forms an openable/closable structure for the device housing 2. A housing cover part 2A constituting a portion of the device housing 2 is integrally formed on a lower portion of the upper cover unit 5 and, when the upper cover unit 5 is opened and closed, the housing cover part 2A is also integrally opened and closed.

The operation button part 5C is provided on an upper surface position near the front of the upper cover unit 5 and is disposed with a power button 7A of the print label producing device 1, a status button 7B for displaying a peripheral equipment actuation state, a feed button 7C, etc.

The touch panel part 5A includes an operation surface (not shown), and a user can perform a desired operation input by touching this operation surface with a fingertip etc. from above and can produce a print label L (see FIG. 4 etc. described later) having a print formed in accordance with the operation. An operation sheet SH is placed on the operation surface so as to facilitate the smooth operation input.

Release knobs 17 are provided on both left and right side walls of the device housing 2. Pushing up of these release knobs 17 releases the upper cover unit 5 locked to the device housing 2 and makes the upper cover unit 5 openable.

The front panel 6 is disposed with a first discharging exit 6A and a second discharging exit 6B located at a position lower than the first discharging exit 6A. A portion of the front panel 6 including the second discharging exit 6B is formed as an opening/closing lid 6C capable of pivoting toward the front side so as to facilitate attachment, discharge, etc. of a print-receiving tape 3A described later, for example.

When the upper cover unit 5 is closed, the first discharging exit 6A is made up of an upper edge portion on the front surface side of the device housing 2 and a lower edge portion of the front surface side of the upper cover unit 5. A cutting blade 8 (cutter) directed downward is attached inside a lower edge portion of the upper cover unit 5 in the first discharging exit 6A (see also FIG. 2 described later).

<Internal Structure>

An internal structure of the print label producing device 1 will be described with reference to FIG. 2.

As shown in FIG. 2, the print label producing device 1 has a concave-shaped roll storage part 4 on the rear side of the internal space of the device housing 2. The roll storage part 4 stores a roll 3 of a print-receiving tape 3A (corresponding to a print-receiving medium) with a desired width wound into a roll shape such that the print-receiving tape 3A is fed out from the upper side of the roll. The upper side of the roll storage part 4 is opened and closed by the upper cover unit 5.

As shown in an enlarged view in FIG. 2, the print-receiving tape 3A constituting the roll 3 has label mount papers LP discretely arranged along the longitudinal direction on a separation material layer 3*c*. The label mount papers LP in this example have a two-layer structure and have a print-receiving layer 3*a* in which a print is formed by a printing head 61 described later and an adhesive layer 3*b* laminated in this order. The label mount papers LP are bonded to a surface on one side of the separation material layer 3*c* at predetermined intervals by an adhesive force of the adhesive layer 3*b*. Therefore, the print-receiving tape 3A has a three-layer structure made up of the print-receiving layer 3*a*, the adhesive layer 3*b*, and the separation material layer 3*c* in portion with the bonded label mount papers LP (see the enlarged view of FIG. 2) and has a single layer structure made up only of the separation material layer 3*c* in a portion without the bonded label mount papers LP (i.e., a portion between the label mount papers LP). After completion of a print, each of the label mount papers LP is finally separated from the separation material layer 3*c* and used as a print label (hereinafter, the label mount paper LP after print formation will be referred to as a "print label L" as appropriate; see FIG. 4 etc. described later).

Three support rollers 51, 52, 53 are provided on a bottom surface portion of the roll storage part 4. When a platen roller 66 (corresponding to a feeder) for feeding the print-receiving tape 3A is rotationally driven to pull out the print-receiving tape 3A from the roll 3, at least two of the support rollers 51-53 are brought into contact with an outer circumferential surface of the roll 3 and are thereby driven to rotate to rotatably support the roll 3. These three support rollers 51-53 are located at respective different circumferential positions relative to the roll 3 and are arranged from the front to the rear along the circumferential direction of the roll 3 in the order of the first support roller 51, the second support roller 52, and the third Support roller 53. These first to third support rollers 51-53 are each divided into a plurality of portions in the left-right direction (in other words, in the roll width direction), and only the portion with the roll 3 mounted thereon rotates in accordance with the roll width.

<Platen Roller, Printing Head, and Peripheral Structure Thereof>

On the other hand, the printing head 61 (corresponding to a printing head) performing a desired print on the print-receiving tape 3A transported by the platen roller 66 is provided on the lower side of a front end portion of the upper cover unit 5. The platen roller 66 is provided on the upper side of a front end portion of the device housing 2, facing the printing head 61 in the up-down direction. A roller shaft 66A of the platen roller 66 is rotatably supported by brackets 65 (see FIG. 2) provided on both axial ends, and a gear (not shown) driving the platen roller 66 is fixed to one shaft end of the roller shaft 66A.

In this case, the gear fixed to the roller shaft 66A of the platen roller 66 meshes with a gear train not shown of the device housing 2, and the platen roller 66 is rotationally driven by a platen roller motor 211 (see FIG. 3 described later) made up of a stepping motor etc. As a result, the platen roller 66 feeds out the print-receiving tape 3A from the roll 3 stored in the roll storage part 4 and transports the print-receiving tape 3A such that the width direction of the tape is in the left-right direction.

The printing head 61 includes a plurality of heat generation elements in a direction orthogonal to the transport direction of the print-receiving tape 3A. The platen roller 66 is arranged on the side facing the surface disposed with the heat generating elements of the printing head 61. The heat generation elements are energized in accordance with dot pattern data to be printed and this leads to a print of characters, graphics, etc. on the print-receiving tape 3A fed out from the roll 3. The driving of the heat generation elements provided on the printing head 61 is performed by a printing head control circuit 217 shown in FIG. 3 described later.

In particular, when the platen roller 66 is rotationally driven and the print-receiving tape 3A is pulled, the print-receiving tape 3A is fed out from the roll 3 and transported with the label mount paper LP side facing upward. On the transported print-receiving tape 3A, the printing head 61 located above the print-receiving tape 3A forms a desired print corresponding to a user's operation to the touch panel part 5A.

Additionally, on the front side relative to the platen roller 66, a separation plate 200 is provided that folds the separation material layer 3*c* downward to the lower side of the platen roller 66. Specifically, by utilizing the fact that the print-receiving layer 3*a* is resilient and unable to follow the folding path as described above, the print-receiving layer 3*a* and the adhesive layer 3*b* are peeled off from the separation material layer 3*c* at the separation plate 200. The print-receiving layer 3*a* with print and the adhesive layer 3*b* (in other words, a print label LP) peeled off from the separation material layer 3*c* by the separation plate 200 are discharged through the first discharging exit 6A located further forward of the separation plate 200 to the outside of the device housing 2. Subsequently, the layers are discharged from the first discharging exit 6A to the outside of the device housing 2 and used as a label. The cutting blade 8 is used by the user for cutting the print-receiving layer 3*a* and the adhesive layer 3*b* discharged through the first discharging exit 6A to the outside of the device housing 2 at a desired position.

On the other hand, a pinch roller 201 is provided below the platen roller 66 so as to transport the separation material layer 3*c* folded downward by the peeling plate 200 while pinching the layer against the platen roller 66. The separation material layer 3*c* transported by the pinch roller 201 is discharged from the second discharging exit 6B to the outside of the device housing 2.

<Control System>

A control system of the print label producing device 1 will be described with reference to FIG. 3.

In FIG. 3, the print label producing device 1 includes a CPU 212 constituting a calculation part performing a predetermined calculation. The CPU 212 is connected to a RAM 213 including a printing buffer 213A described later, a ROM 214, and a memory 215. The CPU 212 is also connected to a motor drive circuit 216 carrying out drive control of the platen roller motor 211 driving the platen roller 66, a printing head control circuit 217 carrying out energization control of the heat generation elements of the printing head 61, and the touch panel part 5A. A timer 212A capable of clocking the date and time of printing by the print label producing device 1 is provided along with an operation detecting part 212B identifying which one of operation regions (not shown) is pressed by a user based on an operation signal of the touch panel part 5A according to a user's touch operation. The CPU 212 is configured to be connectable through an I/O interface 218 to a bar-code reader BR and a personal computer PC (see dashed-two dotted lines).

In the ROM 214, a control program for executing a control process etc. described later (see FIGS. 15 and 22 described later) is stored.

The CPU 212 executes a signal process in accordance with a program stored in advance in the ROM 214 while using a temporary storage function of the RAM 213, thereby generally controlling the print label producing device 1.

<Configuration of Print Label>

An example of the print label L (corresponding to a printed matter) produced as described above is shown in FIG. 4. This example is an example of the print label L produced for equipment management. In FIG. 4, the print label L includes a frame print portion LF, a bar-code print portion LB, and three text print portions LT1, LT2, LT3.

The text print portion LT1 has printed text characters representative of contents corresponding to an item "article name" that is "article name: projector" in this example. The text print portion LT2 has printed text characters representative of contents corresponding to an item "asset code" that is "asset code: 07-123" in this example. The text portion of the text LT3 has printed text characters representative of contents corresponding to an item "purchase date" that is "purchase date: Aug. 24, 2012" in this example.

The bar-code print portion LB has bar-code data recorded as a bar code representative of all the information contents of the items "article name," "asset code," and "purchase date," i.e., "article name: projector," "asset code: 07-123," and "purchase date: Aug. 24, 2012." Therefore, for example, by reading this bar-code print portion LB with an appropriate bar-code reader, the pieces of information "article name: projector," "asset code: 07-123," and "purchase date: Aug. 24, 2012" can be acquired. It is noted that the pattern of the QR code of the bar-code print portion LB shown in FIG. 4 is shown as an example in a simulated manner and does not directly correspond to the text contents in the balloon ("article name: projector," "asset code: 07-123," and "purchase date: Aug. 24, 2012") (the same applies to FIGS. 6B, 9, 10 etc.).

The frame print portion LF constitutes separation lines separating the bar-code print portion LB and the three text print portions LT1, LT2, LT3 from each other and an outer frame line surrounding the whole.

<Database Printing>

The print label L is produced by so-called database printing in which contents of character strings allocated to a template are specified in accordance with records of a database in the print label producing device 1.

<Example of Database>

FIG. 5 is a diagram of an example of a database 30 (e.g., stored in the ROM 214 and the memory 215) used in the database printing. In FIG. 5, the database 30 has records each made up of a group of data of one horizontal row, and each of the records includes a number field 31 having an assigned character string representative of a number (record number), an article name field 35 having an assigned character string representative of a name (an article name) of an object to which the print label L is affixed, an asset code field 33 having an assigned character string representative of an asset code, and a purchase date field 34 having an assigned character string representative of a purchase date of an object to which the print label L is affixed. Each or the records is not limited to having a plurality of records having respective assigned character strings and may have at least one field having at least one assigned character string.

For example, a record on a first row of this database 30 has "1" assigned as a character string representative of a number in the number field 31, "projector" assigned as a character string representative of an article name in the article name field 32, "07-123" assigned as a character string representative of the asset code field 33, and "2012/8/24" assigned as a character string representative of the purchase date field 34. Similarly, a record on a second row has "2" assigned as a character string representative of a number in the number field 31, "printer" assigned as a character string representative of an article name in the article name field 32, "09-224" assigned as a character string representative of the asset code field 33, and "2014/2/5" assigned as a character string representative of the purchase date field 34. Similarly, a record on a third row has "3" assigned as a character string representative of a number in the number field 31, "printer" assigned as a character string representative of an article name in the article name field 32, "09-196" assigned as a character string representative of the asset code field 33, and "2014/7/19" assigned as a character string representative of the purchase date field 34. Similarly, a record on a fourth row has "4" assigned as a character string representative of a number in the number field 31, "copy machine" assigned as a character string representative of an article name in the article name field 32, "08-071" assigned as a character string representative of the asset code field 33, and "2010/1/26" assigned as a character string representative of the purchase date field 34. Similarly, a record on a fifth row has "5" assigned as a character string representative of a number in the number field 31, "whiteboard" assigned as a character string representative of an article name in the article name field 32, "00-348" assigned as a character string representative of the asset code field 33, and "2015/3/3" assigned as a character string representative of the purchase date field 34.

The database 30 is stored in a database storage part 215B (corresponding to a database memory; see FIG. 3) included in the memory 215. In this embodiment, the database 30 is produced in advance by the personal computer PC, for example, and the produced database 30 is sent from the personal computer PC through the I/O interface 215 to the CPU 212 of the print label producing device 1 and stored in the database storage part 215B.

<Template Storage Part>

An example of a template TP used in the database printing is shown in FIGS. 6A and 6B.

In FIG. 6A, the template TP is a template for allocation in a predetermined form of four respective character strings assigned to the four fields 31-34 in each of the records of the database 30 shown in FIG. 5. Therefore, this template TP has five print objects A, B, C, D, E allocated in a predetermined form.

The print object C is an allocation frame corresponding to the character string assigned to the article name field 32 in the records of the database 30 shown in FIG. 3 (with a fixed character string "article name." fixedly arranged therein) and is located in a right upper column in the template TP.

The print object D is an allocation frame corresponding to the character string assigned to the asset code field 33 in the records of the database 30 shown in FIG. 3 (with a fixed character string "asset code:" fixedly arranged therein) and is located on the lower side of the print object C (in other words, in a right middle column) in the template TP.

The print object E is an allocation frame corresponding to the character string assigned to the purchase date field 34 in the records of the database 30 shown in FIG. 3 (with fixed character strings "year," "month," and "day" fixedly arranged therein) and is located on the lower side of the print object D (in other words, in a right lower column) in the template TP.

The print object B is an allocation frame corresponding to a barcode generated by using the character strings assigned to the fields 32, 33, and 34 of the records of the database 30 shown in FIG. 3 and is located on the left side of the print objects C, D, E in the template TP.

The print object A is fixedly arranged as frame lines separating the print objects B, C, D, E from each other and an outer frame line surrounding the whole.

The template TP having the above configuration is stored in a template storage part 215A (corresponding to a template memory; see FIG. 3) included in the memory 215. Therefore, in this embodiment, the template TP is produced in advance by the personal computer PC, for example, and the produced template TP is sent from the personal computer PC through the I/O interface 215 to the CPU 212 of the print label producing device 1 and stored in the template storage part 215A.

<Flow of Database Printing>

At the time of execution of the database printing, for example, when a user (an operator) operates the touch panel part 5A or the operation button part 5C as needed to give a printing instruction for specifying at least one record of the database 30, a plurality of character strings respectively assigned to the fields 32, 33, 34 is inserted into the template TP and allocated to the print objects C, D, E for each of the records of the specified database 30. In this embodiment, instead of operating the touch panel part 5A or the operation button part 5C, the printing instruction can be given by operating the bar-code reader BR (see the dashed-two dotted line in FIG. 3) connected to the I/O interface 215 to scan and read an appropriate bar code (detailed description will not be made). In this case, the bar-code reader BR functions as an operation part of the print label producing device 1.

FIG. 6B shows a case that the record with the record number "1" of the database 30 is selected. In this case, as shown in FIG. 6B, the insertion results in the print object C with contents "article name: projector," the print object D with contents "asset code: 07-123," and the print object E with contents "purchase date: Aug. 24, 2012." Additionally, the print object B has contents acquired from bar-coding of "article name: projector," "asset code: 07-123," and "purchase date: Aug. 24, 2012." It is note that although the print object B has a brank frame (only a frame) as the allocation frame before the insertion in the above example, this is not a limitation. In particular, a bar code of an appropriate form may be arranged by default in the print object B before the insertion and may be replaced with the above contents by the insertion.

For the record number "1," one corresponding print label (the print label L shown in FIG. 4 in this example) is produced by using the template TP to which data has been inserted and allocated as described above. The same applies to the data of the other record numbers "2," "3," etc.

<Data Structure of Template>

A data structure of the template TP as described above will hereinafter be described in detail. From the viewpoint of data, the print objects A-E of the template TP are defined by print data for setting respective individual print forms (such as arrangement, orientation, and font). As described above, the print data of the print object A is the image data of the frame lines; the print data of the print object B is the image data of the bar code; the print data of the print object C is the text data corresponding to the item "article name" (in other words, the article name field 32); the print data of the print object D is the text data corresponding to the item "asset code" (in other words, the asset code field 33); and the print data of the print object E is the text data corresponding to the item "purchase date" (in other words, the purchase date field 32).

Such data of the template TP is made up of arrangement information F of the print objects as schematically shown in FIG. 7, for example. The print object arrangement information F corresponds to the template TP of FIG. 6B titled as "equipment management label" (i.e., the appearance after the data insertion of the record with the record number "1" described above). This arrangement information F includes print data FA, FB, FC, FD, FE corresponding to the five respective print objects A-E.

The print data FA-FE respectively include identification information "Object" of the corresponding print objects A-E, position information "Locate" for when the print objects A-E are arranged, size information "Size" for when the print objects A-E are arranged, attribute information "Type" of the print objects A-E, and data contents "Data." As described later, only the print data FB corresponding to the image data of the bar code also includes standard information "Attribute." Among these, the identification information, the position information, the size information, and the attribute information (as well as the standard information in the case of the print data FB) are collectively referred to as bibliographic data, and data contents themselves are referred to as entity data. It is noted that in FIG. 7, the position information and the size information of the print objects are briefly described as "??,??" instead of specific numerical values.

The print data FA corresponds to the image data of the frame lines of the print object A and includes the bibliographic data made up of the identification information consisting of the character string "Object FIG," the position information represented by coordinates on a paper surface of the print label L in accordance with an appropriate unit setting, the size information represented by an appropriate unit setting, and the attribute information representing that the entity data is image data of frame lines, as well as the entity data represented by a file name "flame.bmp" (see FIGS. 6A and 6B for a frame line image of the contents). In the case of image data of frame lines made up of a combination of simple graphics, not only a raster data format (.bmp, .jpg, .png) but also a vector data format (.dxf, .svg) is applicable.

The print data FB corresponds to the image data of the bar code of the print object B and includes the bibliographic data made up of the identification information consisting of the character string "Object BC," the position information represented by coordinates on the paper surface of the print label L in accordance with an appropriate unit setting, the size information represented by an appropriate unit setting, the attribute information representing that the entity data is text data meaning the contents of the bar code, and the standard information representing that the standard of the bar code is a QR code, as well as the entity data that is text data corresponding to the character strings "article name: projector," "asset code: 07-123," and "purchase date: Aug. 24, 2012" (see FIG. 6B for a coded bar-code image).

The print data FC corresponds to the text data of the print object C and includes the bibliographic data made up of the identification information consisting of the character string "Object 1," the position information represented by coordinates on the paper surface of the print label L in accordance with an appropriate unit setting, the size information represented by an appropriate unit setting, and the attribute information representing that the entity data is text data, as well as the entity data that is text data corresponding to the character string "article name: projector."

The print data FD corresponds to the text data of the print object D and includes the bibliographic data made up of the identification information consisting of the character string "Object 2," the position information represented by coordinates on the paper surface of the print label L in accordance with an appropriate unit setting, the size information represented by an appropriate unit setting, and the attribute information representing that the entity data is text data, as well as the entity data that is text data corresponding to the character string "asset code: 07-123."

The print data FE corresponds to the text data of the print object E and includes the bibliographic data made up of the identification information consisting of the character string "Object 3," the position information represented by coordinates on the paper surface of the print label L in accordance with an appropriate unit setting, the size information represented by an appropriate unit setting, and the attribute information representing that the entity data is text data, as well as the entity data that is text data corresponding to the character string of the Gregorian calendar date "Aug. 24, 2012." Although the entity data of date data is directly written as a character string in this example, the data may be stored as an integer value of a corresponding Japanese or Gregorian calendar date. One template TP is made up of the arrangement information of the print data as described above.

Feature of Embodiment

In the basic configuration of this embodiment as described above, a feature of this embodiment is that when the print label L is produced by the database printing as described above, unique information uniquely retained by the print label producing device 1 (e.g., a serial number defined as individual identification information added to each individual piece of the print label producing device 1) is bar-coded and included in the contents of the bar-code print portion LB. Details will hereinafter be described in order.

As described above, in the print label producing device 1 of this embodiment, the template TP having at least a bar-code object allocated thereto (in this example, both the print object B serving as a bar-code object and the print objects C, D, E serving as text objects are allocated) is stored in the template memory 215A. By producing the print label L by using the template TP, the bar-code print portion LB corresponding to the bar-code object is formed in the print label L.

In this embodiment, an identifier ID in a predetermined form (described later) is provided in advance in the object B that is a bar-code object included in the template TP, so that the serial number of the print label producing device 1 can be acquired (collected) to include the contents thereof into the bar-code print portion LB.

In particular, when a production instruction for the print label L is accepted and the template TP is read from the template memory 215A, the CPU 212 determines whether the identifier ID in a predetermined form (described in detail later) exists in the bar-code object (the object B in the example described above) included in the read template TP and, if exists, the CPU 212 executes bar-coding of the serial number ("printer serial No. XY-451988" in this example; see FIG. 9 described later).

<Example of Template Including Collection Identifier>

An example of the data structure of the template TP including the collection identifier is schematically shown in FIG. 8 corresponding to FIG. 7. In the arrangement information F of FIG. 8, first, the identification information of the print data FB corresponding to the print object B is different from that of FIG. 7. Specifically, in this example, the identification information is made up of a character string "Object_ALL_" and the character string "_ALL_" (corresponding to the collection identifier) is included as the identifier ID.

If this identifier ID "_ALL_" exists, a bar code is generated that represents all the text data ("article name: projector," "asset code: 07-123," and "Aug. 24, 2012" in the example) included in the print data (the print data FA, FB, FC, FD, FE in the example) respectively corresponding to all the print objects (the five print objects A-E in the example) included in this template TP as well as the serial number ("printer serial No. XY-451988" in this example).

In FIG. 8, because of this bar-coding, the entity data of the print data FB is different from that of FIG. 7. Specifically, the text data corresponding to the character string "printer serial No. XY-451988" collected as described above is newly added to the text data corresponding to the character strings "article name: projector," "asset code: 07-123," and "purchase date: Aug. 24, 2012" in the entity data.

By using the template TP having the data structure shown in FIG. 8, the print label L as shown in FIG. 9 is produced that includes the bar-code print portion LB recording the contents bar-coded as described above ("article name: projector," "asset code: 07-123," "Aug. 24, 2012," and "printer serial No. XY-451988" in the example) and the text print portions LT1, LT2, LT3 displaying the text data ("article name: projector," "asset code: 07-123," and "Aug. 24, 2012" in the example).

As shown in FIG. 10, a text print portion LT4 displaying the "printer serial no. XY-451988" may be provided in the print label L in addition to the text print portions LT1, LT2, LT3 displaying "article name: projector," "asset code: 07-123," and "Aug. 24, 2012," respectively.

<Another Example of Template Including Collection Identifier>

Another example of the data structure of the template TP including the collection identifier is schematically shown in FIG. 11 corresponding to FIGS. 7 and 8. In this arrangement information F of FIG. 11, as is the case with FIG. 8, the identification information of the print data FB corresponding to the print object B is different from that of FIG. 7. Specifically, in this example, the identification information is made up of a character string "Object_SR_" and the character string "_SR_" (corresponding to the collection identifier) is included as the identifier ID.

If the identifier ID "_SR_" exists, only the serial number ("printer serial No. XY-451988" in this example) is bar-coded. Accordingly, the entity data of the print data is different from that of FIG. 7. Specifically, the actual data includes only the text data corresponding to the character string "printer serial No. XY-451988" without including the text data corresponding to the character strings "article name: projector," "asset code: 07-123," and "purchase date: Aug. 24, 2012" as described above.

By using the template TP having the data structure shown in FIG. 11, the print label L as shown in FIG. 12 is produced that includes the bar-code print portion LB recording only the contents bar-coded as described above ("printer serial No. XY-451988" in this example) and the text print portions LT1, LT2, LT3 displaying the text data ("article name: projector," "asset code: 07-123," and "Aug. 24, 2012" in the example).

Also in this case, as is the case with FIG. 10, the text print portion LT4 displaying the "printer serial no. XY-451988" may be provided in the print label L in addition to the text print portions LT1, LT2, LT3 displaying "article name: projector," "asset code: 07-123," and "Aug. 24, 2012," respectively.

<Example of Template without Collection Identifier>

In this embodiment, a template TP without the collection identifier according to a technique of prior art is also usable. A data structure of such a template TP is schematically shown in FIG. 14 corresponding to FIGS. 7, 8, and 11. In the arrangement information F of FIG. 14, as is the case with FIGS. 8 and 11, the identification information of the print data FB corresponding to the print object B is different from that of FIG. 7. Specifically, in this example, the identification information is made up of a character string "Object_OBJ_1_2_3" and the character string "_OBJ_1_2_3" not corresponding to the collection identifier is included as the identifier ID. It is noted that only the character strings "_ALL_" and "_SR_" described above correspond to the collection identifier in this embodiment.

If the identifier ID "_OBJ_ . . . " exists, only the text data of the print data of an object having a number portion of identification information specified by the portion of " . . . " is bar-coded out of all the text data ("article name: projector," "asset code: 07-123," and "Aug. 24, 2012" included in the print data (the print data FA, FB, FC, FD, FE in the example) respectively corresponding to all the print objects (the five print objects A-E in the example) included in this template TP. In this example, since "Object_OBJ_1_2_3" specifies three objects "Object 1," "Object 2," and "Object 3," "article name: projector" corresponding to the print data FC, "asset code: 07-123" corresponding to the print data FD, and "Aug. 24, 2012" corresponding to the print data FE are bar-coded.

In FIG. 14, because of the bar-coding, the contents of the entity data of the print data FB are the same as those of FIG. 7. Specifically, the entity data is text data corresponding to the character strings "article name: projector," "asset code: 07-123," and "purchase date: Aug. 24, 2012."

As a result, the arrangement information F of the template TP shown in FIG. 14 has contents substantially equivalent to those of FIG. 7. Therefore, when the template TP having the data structure shown in FIG. 14 is used, the print label L shown in FIG. 4 is produced.

<Control>

The control carried out by the CPU 212 of the print label producing device 1 for achieving the above details will be described with reference to FIG. 15.

In a flowchart shown in FIG. 15, this flow is started when the print label producing device 1 is powered on by a user pressing the power button 7A, for example ("START" position).

First, at step S10, the CPU 212 determines whether a production instruction for the print label L is acquired because the user operates the touch panel part 5A or the operation button part 5C or uses the bar-code reader BR to scan a bar code. If the production instruction is not acquired, the determination of step S10 is negative (S10: NO) and followed by waiting in a loop until a production instruction is acquired. If the production instruction is acquired, the determination of step S10 is affirmative (S10: YES) and the flow goes to step S20. The CPU 212 executing step S10 functions as an instruction accepting portion described in claims.

Subsequently, at step S20, based on the specification of at least one record of the database 30 included in the production instruction for the print label L, the CPU 212 acquires text data of character strings included in the at least one specified record (in this example, all the records of record numbers 1, 2, 3, 4, 5, . . . in this example) from the database 30 (see FIG. 5) stored in the database storage part 215B.

At step S30, the CPU 212 acquires a serial number ("printer serial No. XY-451988" in the example described above) that is unique information of the print label producing device 1 from the ROM 214 in which the information is stored in advance, for example. The CPU 212 executing step S30 functions as a unique information acquiring portion described in claims.

Subsequently, a step S40, the CPU 212 reads the template TP stored in the template storage part 215A of the memory 215. Subsequently, the flow goes to step S50.

At step S50, out of the template TP read at the step S40, the CPU 212 expands a graphic data portion (image data of the frame lines constituting the print data FA of the print object A in the example described above) into the printing buffer 213A of the RAM 213.

Subsequently, at step S60, the CPU 212 determines whether the identifier ID "_SR_" defined as one of the collection identifiers is included in the identification information (object name) of the bar-code object (the print object B in the example) of the template TP read at step S40. If "_SR_" is not included in the identification information, the determination of step S60 is negative (S60: NO) and the flow goes to step S70 described later. If "_SR_" is included in the identification information, the determination of step S60 is affirmative (S60: YES) and the flow goes to step S110.

At step S110, the CPU 212 generates with a known method a bar code representative only of the serial number ("printer serial No. XY-451988" in the example described above) acquired at step S30 and goes to step S90 described later.

On the other hand, at step S70 subsequent to negative determination at step S60, the CPU 212 determines whether the identifier ID "_ALL_" defined as one of the collection identifiers is included in the identification information of the bar-code object (the print object B in the example) of the template TP read at step S40. If "_ALL_" is not included in the identification information, the determination of step S70 is negative (S70: NO) and the flow goes to step S120 described later. If "_ALL_" is included in the identification information, the determination of step S70 is affirmative (S70: YES) and the flow goes to step S80. The CPU 212 executing steps S70 and S60 functions as an identifier determining portion described in claims.

At step S80, the CPU 212 generates with a known method a bar code representative of the serial number ("printer serial No. XY-451988" in the example described above) acquired at step S30 as well as all the text data acquired at step S20, and goes to step S90 described later.

On the other hand, if the determination of step S70 is negative, none of the collection identifiers is included and the identifier ID "_OBJ_ . . . " described above is included in the identification information (object name) of the bar-code object (the print object B in the example) of the template TP read at step S40. In this embodiment, the identification information of the bar-code object always includes one of the identifiers ID "_SR_," "_ALL_," and "OBJ_ . . . ." Therefore, at step S120, the CPU 212 generates with a known method a bar code representative only of the text data of the print data of the object having a number portion of identification information specified by the portion of " . . . " out of the print objects included in the template TP read at the step S40. Subsequently, the flow goes to step S90 described later.

At step S90, the CPU 212 assigns the data bar-coded at step S110, S80, or S120 to the corresponding bar-code object (the print object B in the example), assigns the text data acquired at step S20 to the corresponding print objects (the print objects C, D, E in the example), and expands these data to the printing buffer 213A. The CPU 212 executing step S90 and step S20 described above functions as a text data acquiring portion described in claims, and the CPU 212 executing steps S90 and steps S80 and S110 described above functions as a bar-coding portion described in claims.

Subsequently, at step S100, the CPU 212 drives the platen roller motor 211 through the motor drive circuit 216 and energizes the heat generation elements of the printing head 61 through the printing head control circuit 217. As a result, while the print-receiving tape 3A is transported by the platen roller 66, a print is performed by the printing head 61 based on the contents expanded to the printing buffer 213A at step S90 so as to produce the print label L including the bar-code print portion LB and the text print portions LT1-LT3. The CPU 212 executing step S100 functions as a control portion described in claims. Subsequently, this flow is terminated.

If a print label produced as described above is produced through, for example, steps S60, S110, S90, and S100, only the serial number is recorded in the bar-code print portion LB of the print label L as shown in FIG. 12, for example. For example, if the print label is produced through steps S60, S70, S80, S90, and S100, all the text data included in all the print objects and the serial number are recorded in the bar-code print portion LB of the print label L as shown in FIG. 9, for example. For example, if the print label is produced through steps S60, S70, S120, S90, and S100, only all the text data included in all the print objects are recorded in the bar-code print portion LB of the print label L as shown in FIG. 4, for example.

Although the printer serial number is acquired and bar-coded as the unique information by the CPU 212 in the case taken as an example described above, this is not a limitation. For example, the print date and time (i.e., the production date and time of the print label L) may be acquired and bar-coded by the CPU 212. In this case, the production date and time are acquired from the timer 212A of the CPU 212 at step S30 of FIG. 15.

A second embodiment of the present disclosure will be described with reference to FIGS. 16 to 22. In this embodiment, a print label is produced by forming a print on a print-receiving tape supplied from a cartridge. The portions equivalent to those of the first embodiment are denoted by the same reference numerals as appropriate and will not be described or will be described in a simplified manner.

FIG. 16 is a configuration diagram of a label printer according to this embodiment shown together with a connected bar-code reader. In FIG. 16, to the label producing device 100 (corresponding to a printed matter producing device), the bar-code reader BR is connected through a USB cable 9.

The label producing device 100 has a housing 101, and an opening/closing lid 102 is provided on an upper surface portion of the housing 101 such that the lid can be opened and closed (or the lid may be made detachable and attachable). A tape discharging exit 104 is provided in a front surface portion of the housing 101. The tape discharging exit 104 is used for discharging a label tape 423 with print (see FIG. 18 described later) produced in the housing 101 to the outside of the housing 101.

The bar-code reader BR optically reads information from a bar code BC provided in an appropriate printed body 300, for example. The information read by the bar-code reader BR is output through the USB cable 9 to the label producing device 100. Therefore, in this example, the bar-code reader BR can scan and read the bar code BC so as to give the printing instruction described above to the label producing device 100. As a result, the bar-code reader BR functions as an operation part of the print label producing device 100.

FIG. 17 is a perspective view of an appearance configuration of a cartridge holder inside the housing 101 and a cartridge to be attached thereto with the opening/closing lid 102 of the label producing device 100 opened. In FIG. 17, the opening/closing lid 102 opened upward is not shown to avoid complexity of illustration. FIG. 18 is a view of a peripheral portion of the cartridge holder with a cartridge attached thereto shown together with the cartridge.

In FIGS. 17 and 18, the label producing device 100 has a cartridge holder 427 to which a cartridge 410 can be attached and detached, a printing head 419 (corresponding to a printing head), a feeding roller driving shaft 430 (corresponding to a feeder), and a ribbon take-up roller driving shaft 431 provided inside the housing 101. In this example, the cartridge 410 is a box formed into a substantially rectangular parallelepiped shape as a whole and a head insertion opening 439 penetrating both the top and bottom surfaces is formed in a portion thereof.

The cartridge 410 has a base material tape roll 417 formed by winding a base tape 416, a cover film roll 412 formed by winding a cover film 411 that is a print-receiving medium, a ribbon supply side roll 414 feeding out an ink ribbon 413 for print (unnecessary if the print-receiving medium is a thermal paper tape), a ribbon take-up roller 415 taking up the ink ribbon 413 after print, and a feeding roller 418.

The base tape roll 417 has the base tape 416 wound around a base tape spool 417*a*.

The base tape 416 has a laminated structure of multiple layers (four layers in this example) (see a partially enlarged view of FIG. 18). In particular, from the side wound on the inner side (the right side in the partially enlarged view) to the opposite side (the left side in the partially enlarged view), the tape is made up of an adhesive layer 416*a* made of an appropriate adhesive for bonding the cover film 411, a tape base material layer 416*b* made of PET (polyethylene terephthalate), etc., an adhesive layer 416*c* made of an appropriate adhesive, and a separation sheet 416*d* laminated in this order.

The separation sheet 416*d* is a sheet separated when a finally completed print label (a generic term for a text label L1 and a bar-code label L2 described layer; details will be described later) is affixed to an affixing object such as a predetermined article, so that the label can be affixed by the adhesive layer 416*c* to the affixing object.

The cover film roll 412 has the cover film 411 having substantially the same width as the base tape 416 in this example and wound around a cover film spool 412*a*.

The ribbon supply side roll 414 has the ink ribbon 413 wound around a ribbon supply side spool 414*a*.

The ribbon take-up roller 415 includes a ribbon take-up spool 415*a*, and is driven by the ribbon take-up roller driving shaft 431 of the cartridge holder 427 to take up and wind the (used) ink ribbon 413 after print around the ribbon take-up spool 415*a*.

The feeding roller 418 is driven by the feeding roller driving shaft 430 of the cartridge holder 427 to feed a tape in the direction indicated by an arrow T of FIG. 18 while pressing and bonding the base tape 416 and the cover film 411 to form the label tape 423 with print.

The ribbon take-up roller 415 and the feeding roller 418 are rotationally driven in conjunction with each other by a drive force transmitted from a feeding motor 433 (see FIG. 19 described later) that is, for example, a pulse motor provided outside the cartridge 410, through a gear mechanism not shown to the ribbon take-up roller driving shaft 431 and the feeding roller driving shaft 430, respectively.

On the other hand, the cartridge holder 427 has the printing head 419, the ribbon take-up roller driving shaft 431, the feeding roller driving shaft 430, and a roller holder 422.

The printing head 419 has a multiplicity of heat generation elements and forms a print on the cover film 411 fed out and transported from the cover film roll 412.

The feeding roller driving shaft 430 drives the feeding roller 418 to transport the cover film 411 fed out (supplied) from the cover film roll 412 of the cartridge 410 attached to the cartridge holder 427 and the base tape 416 fed out from the base tape roll 417.

The roller holder 422 is pivotally supported by a support shaft 429 and can be switched between a printing position and a release position by a switching mechanism. A platen roller 420 and a tape pressure contact roller 421 are rotatably disposed on the roller holder 422 and, when the roller holder 422 is switched to the printing position, the platen roller 420 and the tape pressure contact roller 421 are pressed against the printing head 419 and the feeding roller 418.

Additionally, the cartridge holder 427 has a cutter 428 (corresponding to a cutter) disposed adjacently to a discharging exit (not shown) of the cartridge 410. The cutter 428 is actuated by exciting a solenoid 435 (see FIG. 19 described later) and completely cuts the label tape 423 with print in the thickness direction to generate each of the text label L1 and the bar-code label L2 described later (see FIG. 20 described later).

In the configuration, after the cartridge 410 is attached to the cartridge holder 427, the ribbon take-up roller driving shaft 431 and the feeding roller driving shaft 430 are rotationally driven in synchronization with each other by the drive force of the feeding motor 433 (see FIG. 19 described later). The driving of the feeding roller driving shaft 430 rotates the feeding roller 418, the platen roller 420, and the tape pressure contact roller 421, and the base tape 416 is fed out from the base tape roll 417 and supplied to the feeding roller 418 as described above. On the other hand, the cover film 411 is fed out from the cover film roll 412, and a plurality of the heat generation elements of the printing head 419 is energized by a printing head drive circuit 432 (see FIG. 19 described later). In this state, the ink ribbon 413 is pressed against the printing head 419 and thereby brought into contact with the back surface of the cover film 411. As a result, a desired print (mirror image print) is formed in a predetermined print area on the back surface of the cover film 411. The base tape 416 and the cover film 411 after completion of the print are bonded and integrated by the feeding roller 418 and the tape pressure contact roller 421 into a label tape 423 with print, which is transported to the outside of the cartridge 410. The label tape 423 with print is then cut by the cutter 428 to generate the print label (corresponding to a printed matter) having the desired print.

FIG. 19 is a functional block diagram of a functional configuration of the label producing device 100.

In FIG. 19, a control circuit 440 is disposed on a control board (not shown) of the label producing device 100. A CPU 444 is provided on the control circuit 440, and this CPU 444 is connected through a data bus 442 to an I/O interface 441, a ROM 446, a memory 447, a RAM 448, and a communication interface 443H. The communication interface 443H is connected through the USB cable 9 to the bar-code reader BR.

The ROM 446 stores various programs necessary for control. The CPU 444 executes various calculations based on various programs stored in the ROM 446. The RAM 448 temporarily stores various calculation results etc. calculated by the CPU 444. A printing buffer 448A is provided on the RAM 448 as is the case with the embodiment described above. As is the case with the first embodiment, the memory 447 includes a database storage part 447B (corresponding to a database memory) in which the database 30 is stored and a template storage part 447A (corresponding to a template memory) in which the template TP is stored.

The I/O interface 441 is connected to the printing head drive circuit 432 for driving the printing head 419, a feeding motor drive circuit 434, and a solenoid drive circuit 436 driving the solenoid 435.

The feeding motor drive circuit 434 drives the feeding motor 433 to drive the feeding roller driving shaft 430 and the ribbon take-up roller driving shaft 431 described above, thereby transporting the base tape 416, the cover film 411, and the label tape 423 with print.

The solenoid drive circuit 436 excites the solenoid 435 driving the cutter 428 to perform a cutting operation.

In the control system centering on the control circuit 440 shown in FIG. 19, as is the case with the first embodiment, the print label L is produced in this embodiment by so-called database printing in which contents of character strings allocated to the template TP are specified in accordance with records of the database 30. In this case, for example, a user (an operator) operates the bar-code reader BR to scan and read the bar code 300, thereby giving a printing instruction for specifying at least one record of the database 30 as in the above description. As a result, a plurality of character strings respectively assigned to the fields 32, 33, 34 is inserted into the template TP and allocated to the print objects C, D, E described above for each of the records of the specified database 30. Subsequently, the template TP after the data insertion and allocation is used for producing the print label as in the above description.

An example of the print label produced in the label producing device 100 according to this embodiment as described above is shown in FIG. 20. In FIG. 20, as described above, the print label is produced by using the label tape 423 with print in this example and is made up of the text label L1 and the bar-code label L2 generated separately from each other by cutting the tape by the cutter 428. This example corresponds to the print label L of FIG. 10 and the bar-code label L2 includes the bar-code print portion LB recording the contents bar-coded as described above ("article name: projector", "asset code: 07-123," "Aug. 24, 2012," and "printer serial No. XY-451988" described above). The text label L1 includes the text print portions LT1, LT2, LT3, LT4 displaying the respective text data ("article name: projector," "asset code: 07-123," "Aug. 24, 2012," and "Printer serial No. XY-451988" in the example).

FIG. 21 is a cross-sectional view taken along a line X-X of FIG. 20. As shown in FIG. 21, the text label L1 has a five-layer structure with the cover film 411 added to the base tape 416 shown in FIG. 3. In particular, from the surface (the upper side of FIG. 21) to the opposite side (the lower side of FIG. 21), the label is made up of the cover film 411, the adhesive layer 416*a*, the tape base material layer 416*b*, the adhesive layer 416*c*, and the separation sheets 416*d* laminated in this order.

On the back surface of the cover film 411, a print R made up of characters of "article name: projector," "asset code: 07-123," "purchase date: Aug. 24, 2012," and "printer serial No. XY-451988" is printed as a mirror image print as described above.

Although not shown, the bar-code label L2 has the same layer configuration as the text label L1, and a bar-code print RB recording the contents of "article name: projector," "asset code: 07-123," "purchase date: Aug. 24, 2012," and "printer serial No. XY-451988" is printed in the bar-code print portion LB on the back of the cover film 411 as a mirror image print as described above.

FIG. 22 shows a flowchart of the control carried out by the CPU 444 of the label producing device 100 of this embodiment. In the flow shown in FIG. 22, steps S101 and S102 are newly provided instead of step S100 of FIG. 15 of the first embodiment described above. Therefore, after the same procedures from step S10 as those of FIG. 15 and the completion of assignment of the bar-coded data to the bar-code object (the print object B in the example), assignment of the text data to the corresponding print objects (the print objects C, D, E in the example), and expanding of these data to the printing buffer 448A at step S90, the flow goes to newly provided steps S101 and S102.

At steps S101 and S102, as is the case with step S100 described above, the CPU 444 drives the feeding motor 433 through the feeding motor drive circuit 434 and energizes the heat generation elements of the printing head 419 through the printing head drive circuit 432. As a result, while the feeding roller driving shaft 430 and the ribbon take-up roller driving shaft 431 are driven and the base tape 416, the cover film 411, and the label tape 423 with print are transported, a print is performed by the printing head 419 based on the contents expanded to the printing buffer 448A at step S90. The CPU 444 excites the solenoid 435 through the solenoid drive circuit 436 to drive the cutter 428. As a result, the text label L1 including the text print portions LT1, LT2, LT3, LT4 is produced at step S101, and the bar-code label L2 including the bar-code print portion LB is produced at step S102. The CPU 444 executing steps S101 and S102 functions as the control portion described in claims. In the example shown in FIG. 20, the text label L1 and the bar-code label L2 are produced through steps S60, S70, S80, S90, S101, and S102. Therefore, as in the above description, the bar-code label L2 has all the text data included in all the print objects and the serial number recorded in the bar-code print portion LB.

In the second embodiment, although the label tape 423 with print is completely cut in the thickness direction by the cutter 428 so that the text label L1 and the bar-code label L2 are generated separately from each other, this is not a limitation. In particular, instead of the cutter 428, a half cutter (not shown) corresponding to another example of a cutter may be provided so as to partially cut the label tape 423 with print in the thickness direction. In this case, the text label L1 and the bar-code label L2 can be generated in a state of being partially connected to each other. Also in this case, the same advantage as above is obtained.

Although the printer serial number is acquired and bar-coded as the unique information by the CPU 212 in the case taken as an example described above, this is not a limitation. For example, after the template TP is read as described above and the data insertion and allocation described above are performed from the database 30, the contents of the text objects (the print objects C, D, E in the example described above) included in the template TP are edited in some cases with an appropriate operation device (such as the touch panel part 5A and the operation button part 5C of the print label producing device 1 of the first embodiment and operation buttons not shown provided on the housing 101 of the label producing device 100 of the second embodiment). In such a case, edit process information related to the editing (which may be the edited contents themselves or the presence of editing) may be acquired and bar-coded by the CPU 212, 444.

In this case, the edit information is stored in, for example, the RAM 213, 448 immediately after the editing, and the edit information is acquired from the RAM 213, 448 at step S30 of FIGS. 15 and 22. Also in these cases, the same advantage as above is obtained.

In the above description, the arrows shown in FIGS. 3 and 19 indicate an example of signal flow and are not intended to limit the signal flow directions.

The flowcharts shown in FIGS. 15 and 22 are not intended to limit the present disclosure to the procedures shown in the flows and the procedures may be added/deleted or may be executed in different order without departing from the spirit and the technical ideas of the disclosure.

The techniques of the embodiments and modification examples may appropriately be utilized in combination other than those described above.

Although not exemplarily illustrated one by one, the present disclosure is implemented with other various modifications without departing from the spirit thereof.

What is claimed is:

1. A printed matter producing device comprising:

a feeder configured to feed a print-receiving medium;

a printing head configured to perform a print on said printing-receiving medium;

a template memory configured to store a template configured to have at least one print object that includes a bar-code object and is allocated in a predetermined form; and a controller;

said controller being configured to execute:

an instruction accepting process for accepting a production instruction for a printed matter by means of using said print-receiving medium;

a unique information acquiring process for using the acceptance of said production instruction in said instruction accepting process as a trigger to acquire unique information uniquely retained by said printed matter producing device;

an identifier determining process for using the acceptance of said production instruction in said instruction accepting process as a trigger to read said template stored in said template memory so as to determine whether a predetermined collection identifier exists or not in the read template;

a bar-coding process for generating bar code print data and expanding the bar code print data to a printing buffer in the case that it is determined in said identifier determining process that said collection identifier is present, the bar code print data having said unique information acquired in said unique information acquiring process, is bar-coded and assigned to contents of said bar-code object included in said template; and a control process for controlling said feeder and said printing head by using said bar code print data expanded to said printing buffer in said bar-coding process so as to produce said printed matter having a bar-code print portion corresponding to said bar-code object after said assignment is applied.

2. The printed matter producing device according to claim 1, wherein said at least one print object includes a plurality of print objects, said plurality of said print objects including said bar-code object and a text object is allocated to said template stored in said template memory, the controller is further configured to execute a text data acquiring process for acquiring text data for assignment to contents of said text object and for expanding the text data as a portion of said bar code print data to said printing buffer, wherein in said control process said feeder and said printing head are controlled by using said bar code print data expanded to said printing buffer so as to produce said printed matter further having a text print portion corresponding to said text object assigned with said text data acquired in said text data acquiring process.

3. The printed matter producing device according to claim 2, further comprising a database memory configured to store a database including a plurality of records each having at least one character string respectively assigned to at least one field, wherein in said text data acquiring process, the acceptance of said production instruction specifying said at least one record included in said database stored in said database memory in said instruction accepting process is used as a trigger to acquire and expand said at least one character string included in said record specified by the production instruction as said text data to said printing buffer, and in said control process, said feeder and said printing head are controlled by using said at least one character string expanded to said printing buffer so as to produce said printed matter corresponding to said specified record and further having said text print portion corresponding to said text object assigned with said at least one character string acquired in said text data acquiring process.

4. The printed matter producing device according to claim 2, further comprising a cutter configured to completely or partially cut said print-receiving medium in a thickness direction, wherein in said control process, said feeder, said printing head, and said cutter are controlled so as to produce said printed matter completely or partially cut by said cutter between said bar-code print portion and said text print portion.

5. The printed matter producing device according to claim 2, wherein in said bar-coding process, said bar code print data is generated and expanded to a printing buffer in the case that it is determined that said collection identifier is present in said identifier determining process, wherein said bar code print data has said unique information acquired by said unique information acquiring process as well as said text data acquired in the text data acquiring process that are both bar-coded and assigned to contents of said bar-code object included in said template, and in said control process, said feeder and said printing head are controlled by using said bar code print data expanded to said printing buffer in said bar-coding process so as to produce said printed matter having said bar-code print portion corresponding to said bar-code object after said assignment is applied in said bar-coding process and said text print portion corresponding to said text object assigned with said text data acquired in said text data acquiring process.

6. The printed matter producing device according to claim 1, wherein said unique information acquired in said information acquiring process includes at least one of an individual identification number of said printed matter producing device and production date/time of said printed matter.

7. A printed matter producing device according to claim 1, wherein said unique information acquired in said information acquiring process includes information of an edit process to contents preliminarily assigned to said text object of said template read from said template memory.

* * * * *